US011539110B2

(12) United States Patent
Kaistha et al.

(10) Patent No.: US 11,539,110 B2
(45) Date of Patent: Dec. 27, 2022

(54) LENSED BASE STATION ANTENNAS HAVING HEAT DISSIPATION ELEMENTS

(71) Applicant: CommScope Technologies LLC, Hickory, NC (US)

(72) Inventors: Amit Kaistha, Coppell, TX (US); Michel Dembinski, Dallas, TX (US); Yongjie Xu, Jiangsu (CN); Xiangyang Ai, Plano, TX (US); Gilberto Guerra, Denton, TX (US); XiaoHua Hou, Richardson, TX (US); Walter Mark Hendrix, Richardson, TX (US); Willis Frank James, Wylie, TX (US)

(73) Assignee: CommScope Technologies LLC, Hickory, NC (US)

( * ) Notice: Subject to any disclaimer, the term of this patent is extended or adjusted under 35 U.S.C. 154(b) by 11 days.

(21) Appl. No.: 17/280,963

(22) PCT Filed: Oct. 8, 2019

(86) PCT No.: PCT/US2019/055173
§ 371 (c)(1),
(2) Date: Mar. 29, 2021

(87) PCT Pub. No.: WO2020/076814
PCT Pub. Date: Apr. 16, 2020

(65) Prior Publication Data

US 2021/0384606 A1 Dec. 9, 2021

Related U.S. Application Data

(60) Provisional application No. 62/859,967, filed on Jun. 11, 2019, provisional application No. 62/772,752, (Continued)

(51) Int. Cl.
*H01Q 1/02* (2006.01)
*H01Q 1/24* (2006.01)
(Continued)

(52) U.S. Cl.
CPC ..... *H01Q 1/02* (2013.01); *H01Q 1/246* (2013.01); *H01Q 15/02* (2013.01); (Continued)

(58) Field of Classification Search
CPC ..... H01Q 1/02; H01Q 1/246; H01Q 15/02; H01Q 15/04; H01Q 15/06; H01Q 15/08; (Continued)

(56) References Cited

U.S. PATENT DOCUMENTS 3,133,285 A 5/1964 Jordan et al.
3,293,649 A * 12/1966 Fox ..... H01Q 1/02 343/911 R
5,677,796 A * 10/1997 Zimmerman ..... H01Q 15/08 359/720
6,426,814 B1 7/2002 Berger et al.
(Continued)

FOREIGN PATENT DOCUMENTS

WO 2015139294 A1 9/2015
WO 2020041467 A1 2/2020

OTHER PUBLICATIONS

International Search Report and the Written Opinion of the International Searching Authority corresponding to International Patent Application No. PCT/US2019/055173 (12 pages) (dated Jan. 2, 2020).

(Continued)

*Primary Examiner* — Robert Karacsony
(74) *Attorney, Agent, or Firm* — Myers Bigel, P.A.

(57) ABSTRACT

A base station antenna includes a radio frequency (RF) lens positioned to receive electromagnetic radiation from a radiating element, the RF lens including an RF energy focusing material and a first heat dissipation channel that extends through the RF energy focusing material of the RF lens and contains a cooling fluid.

20 Claims, 29 Drawing Sheets

Related U.S. Application Data filed on Nov. 29, 2018, provisional application No. 62/744,940, filed on Oct. 12, 2018.

(51) Int. Cl.

| | |
|---|---|
| ***H01Q 15/02*** | (2006.01) |
| ***H01Q 19/06*** | (2006.01) |
| ***H01Q 21/08*** | (2006.01) |
| ***H01Q 25/00*** | (2006.01) |

(52) U.S. Cl.
CPC ..... *H01Q 19/062* (2013.01); *H01Q 21/08* (2013.01); *H01Q 25/001* (2013.01)

(58) Field of Classification Search
CPC ..... H01Q 15/10; H01Q 15/12; H01Q 19/062; H01Q 21/08; H01Q 25/001
See application file for complete search history.

(56) References Cited

U.S. PATENT DOCUMENTS

| | | | |
|---|---|---|---|
| 7,405,710 | B2 | 7/2008 | Bisiules et al. |
| 9,819,094 | B2 | 11/2017 | Matitsine et al. |
| 2007/0263856 | A1 | 11/2007 | Parsa |
| 2011/0003131 | A1 | 1/2011 | Matitsine |
| 2011/0205119 | A1 | 8/2011 | Timofeev et al. |
| 2012/0020020 | A1 | 1/2012 | Julien et al. |
| 2015/0070230 | A1 | 3/2015 | Bradley et al. |
| 2015/0091767 | A1 | 4/2015 | Matitsine et al. |
| 2018/0131078 | A1 | 5/2018 | Shooshtari et al. |
| 2018/0166789 | A1 | 6/2018 | Galla et al. |
| 2021/0399433 | A1 | 12/2021 | Zimmerman |

OTHER PUBLICATIONS

International Search Report and Written Opinion of the International Searching Authority, PCT/US2019/059388, dated Jan. 13, 2020, 13 pp.

* cited by examiner

LENSED BASE STATION ANTENNAS HAVING HEAT DISSIPATION ELEMENTS

CROSS-REFERENCE TO RELATED APPLICATIONS

The present application is a 35 USC § 371 US national stage application of PCT/US2019/055173, filed Oct. 8, 2019, which claims priority to U.S. Provisional Patent Application Ser. No. 62/859,967, filed Jun. 11, 2019, to U.S. Provisional Patent Application Ser. No. 62/772,752, filed Nov. 29, 2018, and to U.S. Provisional Patent Application Ser. No. 62/744,940, filed Oct. 12, 2018, the entire content of each of which is incorporated herein by reference.

FIELD OF THE INVENTION

The present disclosure relates generally to radio communications and, more particularly, to lensed antennas utilized in cellular and other communications systems.

BACKGROUND

Cellular communications systems are well known in the art. In a typical cellular communications system, a geographic area is divided into a series of regions that are referred to as "cells," and each cell is served by a base station. The base station may include baseband equipment, radios and base station antennas that are configured to provide two-way radio frequency ("RF") communications with subscribers that are positioned throughout the cell. In many cases, the cell may be divided into a plurality of "sectors," and separate base station antennas provide coverage to each of the sectors. The antennas are often mounted on a tower or other raised structure, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular relative to the plane defined by the horizon.

A very common base station configuration is a so-called "three sector" configuration in which the cell is divided into three 120° sectors in the azimuth plane, and the base station includes three base station antennas that provide coverage to the three respective sectors. The azimuth plane refers to a horizontal plane that bisects the base station antenna that is parallel to the plane defined by the horizon. In a three sector configuration, the antenna beams generated by each base station antenna typically have a Half Power Beam Width ("HPBW") in the azimuth plane of about 65° so that the antenna beams provide good coverage throughout a 120° sector. Typically, each base station antenna will include a vertically-extending column of radiating elements that is typically referred to as a "linear array." Each radiating element in the linear array may have a HPBW of approximately 65° so that the antenna beam generated by the linear array will provide coverage to a 120° sector in the azimuth plane. In many cases, the base station antenna may be a so-called "multi-band" that includes two or more arrays of radiating elements that operate in different frequency bands.

Sector-splitting refers to a technique where the coverage area for a base station is divided into more than three sectors, such as six, nine or even twelve sectors. A six-sector base station will have six 60° sectors in the azimuth plane. Splitting each 120° sector into multiple smaller sub-sectors increases system capacity because each antenna beam provides coverage to a smaller area, and therefore can provide higher antenna gain and/or allow for frequency reuse within a 120° sector. In sector-splitting applications, a single multibeam antenna is typically used for each 120° sector. The multibeam antenna generates two or more antenna beams within the same frequency band, thereby splitting the sector into two or more smaller sub-sectors.

One technique for implementing a multibeam antenna is to mount two or more linear arrays of radiating elements that operate in the same frequency band within an antenna that are pointed at different azimuth angles, so that each linear array covers a pre-defined portion of a 120° sector such as, for example, half of the 120° sector (for a dual-beam antenna) or a third of the 120° sector (for a tri-beam antenna). Since the azimuth beamwidth of typical radiating elements is usually appropriate for covering a full 120° sector, an RF lens may be mounted in front of the linear arrays of radiating elements that narrows the azimuth beamwidth of each antenna beam by a suitable amount for providing service to a sub-sector. Unfortunately, however, the use of RF lenses may increase the size, weight and cost of the base station antenna, and there may be other issues associated with the use RF lenses.

SUMMARY

In some embodiments of the inventive concept, a base station antenna comprises a radio frequency (RF) lens positioned to receive electromagnetic radiation from a radiating element, the RF lens including an RF energy focusing material and a first heat dissipation channel that extends through the RF energy focusing material of the RF lens and contains a cooling fluid.

In other embodiments, the first heat dissipation channel is one of a plurality of heat dissipation channels that extend through the RF energy focusing material of the RF lens and each of the plurality of heat dissipation channels contains the cooling fluid.

In still other embodiments, the base station antenna further comprises a condenser that is coupled to the plurality of heat dissipation channels so as to facilitate circulation of the cooling fluid therebetween.

In still other embodiments, the condenser has a plurality of cooling fins thereon.

In still other embodiments, the cooling fluid is configured to transition from a liquid state into a gas state in response to heat from the RF energy focusing material.

In still other embodiments, the condenser is configured to cool the cooling fluid so as to cause a transition of the cooling fluid from the gas state to the liquid state.

In still other embodiments, each of the plurality of heat dissipation channels comprises an outer pipe and an inner pipe within the outer pipe. The cooling fluid is between the inner pipe and the outer pipe.

In still other embodiments, inner pipe contains air.

In still other embodiments, the inner pipe contains a lattice structure configured to rectify the electromagnetic radiation.

In still other embodiments, the inner pipe and the outer pipe are formed of a thermally conductive plastic material.

In still other embodiments, the base station antenna further comprises a turbine that is coupled to the plurality of heat dissipation channels at a first end of the RF lens and is configured to pull air into the plurality of inner pipes at the second end of the RF lens and to extract air from the plurality of inner pipes at the first end of the RF lens.

In still other embodiments, the turbine is a wind activated turbine.

In still other embodiments, the turbine comprises a non-metallic material.

In still other embodiments, the base station antenna further comprises a vent that is coupled to the plurality of heat dissipation channels at a first end of the RF lens and is configured to direct air into the plurality of inner pipes at the first end of the RF lens. The plurality of inner pipes are open at the second end of the RF lens allowing the air to escape therefrom.

In still other embodiments, the vent is rotatably coupled to the plurality of heat dissipation channels.

In still other embodiments, the vent comprises a non-metallic material.

In still other embodiments, the cooling fluid has a dielectric constant not less than a dielectric constant of the RF energy focusing material.

In still other embodiments, the dielectric constant is about 1.8.

In still other embodiments, the cooling fluid is configured to change from a liquid state at temperatures above a transition threshold temperature. The transition threshold temperature is in a range of about 45° C. to about 60° C.

In still other embodiments, the first heat dissipation channel extends vertically through the RF lens when the base station antenna is mounted for use.

In still other embodiments, the RF lens comprises an outer shell, the RF energy focusing material within the outer shell, and the first heat dissipation channel extending vertically through the RF energy focusing material.

In still other embodiments, the RF lens comprises a cylindrical RF lens, a spherical RF lens, or an ellipsoidal RF lens.

In still other embodiments, the RF energy focusing material comprises an artificial dielectric material.

In some embodiments of the inventive concept, a base station antenna comprises a plurality of linear arrays of radiating elements that are configured to generate a plurality of radio frequency (RF) beams, respectively, each of the plurality of RF beams having an associated radiation profile, an RF lens including an RF energy focusing material configured to receive the plurality of RF beams, and a first heat dissipation channel that contains a cooling fluid and extends through the RF energy focusing material, the first heat dissipation channel being positioned in the RF lens so as to intersect with each of the plurality of radiation profiles.

In further embodiments, the first heat dissipation channel is one of a plurality of heat dissipation channels containing the cooling fluid that extend through the RF energy focusing material of the RF lens, each of the plurality of heat dissipation channels being positioned in the RF lens so as to intersect with at least one of the plurality of radiation profiles.

In still further embodiments, each of the plurality of heat dissipation channels comprises an outer pipe and an inner pipe within the outer pipe. The cooling fluid is between the inner pipe and the outer pipe.

In still further embodiments, the inner pipe contains air.

In still further embodiments, the inner pipe contains a lattice structure configured to rectify the electromagnetic radiation.

In still further embodiments, the base station antenna further comprises a turbine that is coupled to the plurality of heat dissipation channels at a first end of the RF lens and is configured to pull air into the plurality of inner pipes at the second end of the RF lens and to extract air from the plurality of inner pipes at the first end of the RF lens.

In still further embodiments, the turbine is a wind activated turbine.

In still further embodiments, the turbine comprises a non-metallic material.

In still further embodiments, the base station antenna further comprises a vent that is coupled to the plurality of heat dissipation channels at a first end of the RF lens and is configured to direct air into the plurality of inner pipes at the first end of the RF lens. The plurality of inner pipes are open at the second end of the RF lens allowing the air to escape therefrom.

In still further embodiments, the vent is rotatably coupled to the plurality of heat dissipation channels.

In still further embodiments, the vent comprises a non-metallic material.

In some embodiments of the inventive concept, a base station antenna comprises a plurality of linear arrays of radiating elements that are configured to generate a plurality of radio frequency (RF) beams, an RF lens including an RF energy focusing material positioned and configured to receive the plurality of RF beams, a plurality of heat dissipation channels that extend through the RF energy focusing material of the RF lens, each of the plurality of heat dissipation channels containing cooling fluid, and a condenser that is coupled to the plurality of heat dissipation channels so as to facilitate circulation of the cooling fluid therebetween.

In other embodiments, the cooling fluid is configured to transition from a liquid state into a gas state in response to heat from the RF energy focusing material.

In still other embodiments, the condenser is configured to cool the cooling fluid so as to cause a transition of the cooling fluid from the gas state to the liquid state.

In still other embodiments, the cooling fluid has a dielectric constant not less than a dielectric constant of the RF energy focusing material.

In still other embodiments, the dielectric constant is about 1.8.

In still other embodiments, the cooling fluid is configured to change from a liquid state at temperatures above a transition threshold temperature. The transition threshold temperature is in a range of about 45° C. to about 60° C.

Other apparatus, methods, systems, and/or articles of manufacture according to embodiments of the inventive subject matter will be or become apparent to one with skill in the art upon review of the following drawings and detailed description. It is intended that all such additional apparatus, methods, systems, and/or articles of manufacture be included within this description, be within the scope of the present inventive subject matter, and be protected by the accompanying claims.

BRIEF DESCRIPTION OF THE DRAWINGS

Other features of embodiments will be more readily understood from the following detailed description of specific embodiments thereof when read in conjunction with the accompanying drawings, in which.

DETAILED DESCRIPTION

Figure 1A:
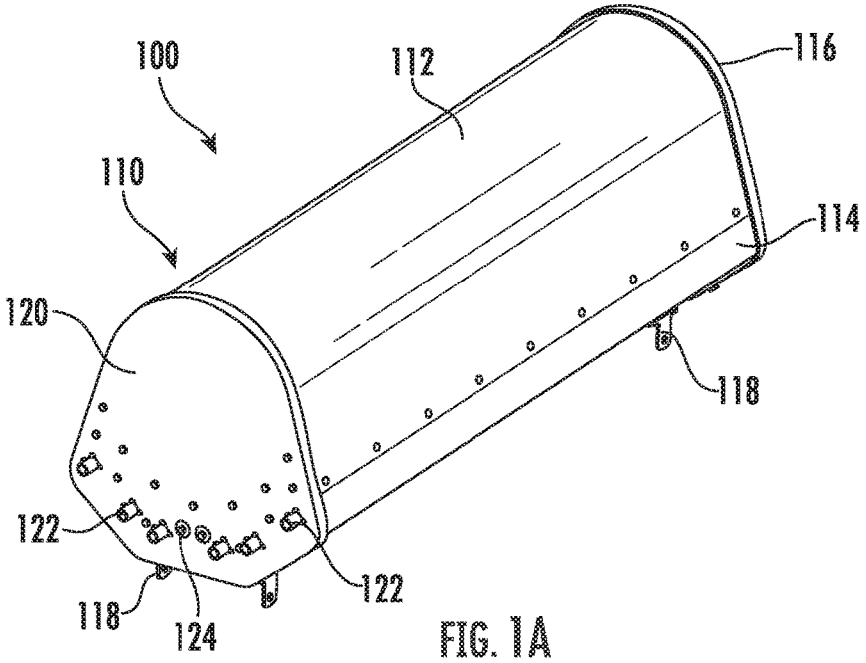
FIG. 1A is a perspective view of a lensed base station antenna.

In the following detailed description, numerous specific details are set forth to provide a thorough understanding of embodiments of the present disclosure. However, it will be understood by those skilled in the art that the present inventive concept may be practiced without these specific details. In some instances, well-known methods, procedures, components and circuits have not been described in detail so as not to obscure the present disclosure. It is intended that all embodiments disclosed herein can be implemented separately or combined in any way and/or combination. Aspects described with respect to one embodiment may be incorporated in different embodiments although not specifically described relative thereto. That is, all embodiments and/or features of any embodiments can be combined in any way and/or combination.

As noted above, one approach for implementing sector splitting is providing base station antennas having two or more arrays of radiating elements that point to different portions of a sector, and using an RF lens to narrow the beamwidths of the antenna beams generated by the arrays so that the antenna beams are sized to provide coverage to respective portions of the sector. The RF lens includes an RF energy focusing material that narrows the beamwidths of the antenna beams. A variety of different RF energy focusing materials may be used to form an RF lens. For example, various dielectric materials are commercially available that may be used to focus RF energy incident thereto. Generally speaking, the higher the dielectric constant of the lens material, the more RF focusing that will occur. While RF lenses may readily be designed that will significantly focus RF energy incident thereto, size, cost and weight considerations must also be taken into account in base station antenna design. Consequently, so-called "artificial" dielectric materials have been introduced that include metal or other non-dielectric materials dispersed within a dielectric base material to create a composite material that has electromagnetic properties that similar to those of high dielectric constant dielectric materials. Various artificial dielectric materials have been proposed that are both lightweight and relatively low cost that can significantly focus RF energy in the cellular frequency bands. RF lenses formed with both conventional dielectric materials and well as RF lenses formed using artificial dielectric materials are in use today.

While RF lenses provide a convenient mechanism for implementing sector-splitting, various difficulties may arise when trying to use lensed multi-beam antennas in practice. One such difficulty is that not all of the RF energy that is injected into the RF lens will pass through the RF lens as radiated RF energy. Consequently, the RF lens has an associated insertion loss that reduces the performance of the antenna. Moreover, the RF energy that fails to pass through the RF lens is, at least in part, converted to heat, which may cause the RF energy focusing material of the RF lens to heat up significantly. If sufficient heat builds up in the RF lens, the heat may damage the RF energy focusing material of the RF lens, which alters the electromagnetic properties of the RF lens, degrading the performance of the antenna.

Pursuant to embodiments of the present inventive concept, base station antennas are provided that include RF lenses having heat dissipation elements such as air channels, cooling fans and the like that may be used to vent heat from the interior of the RF lens. The heat dissipation elements may be used to maintain the temperature of the RF energy focusing material of the RF lens below levels where the RF energy focusing material is damaged or at which the electromagnetic properties of the RF energy focusing material is altered in a manner than materially impacts the performance of the RF lens. RF lenses that include the heat dissipation elements according to embodiments of the present inventive concept may be operated at higher power levels without compromising RF performance.

In some embodiments, the heat dissipation elements may comprise one or more air-filled channels (e.g., pipes or other shaped structures) that extend through the RF lens. Heat may dissipate through the material of the channels to the air-filled interior of the pipes, where the heat may be vented outside the antenna. In some embodiments, small electric fans may be positioned at or near the upper ends of the pipes that blow the heated air out of the antenna. In other embodiments, passive apparatus, such as a wind turbine and/or a rotatable vent may be used to draw air through the heat dissipation channels. In some embodiments, the heat dissipation channels may be formed of thermally conductive plastic materials that may more easily transfer heat that builds-up within the RF lens material to the air-filled interior of the heat dissipation channels. In other embodiments, the heat dissipation elements may comprise one or more channels containing cooling fluid. A condenser may be coupled to the heat dissipation channels thereby allowing the cooling fluid to circulate between the channels and the condenser. In some embodiments, the heat dissipation channels may include both a cooling fluid filled chamber and an air or lattice filled chamber.

The number and location of the heat dissipation channels may be selected to dissipate the heat from the areas of the RF lens that tend to heat up the most. These areas may include the region of the RF lens that is closest to the radiating elements and the region(s) of the RF lens that have the most RF energy passing therethrough, such as the center of the RF lens, and areas that intersect with the radiation patterns associated with the RF beams. The heat dissipation elements may also be arranged symmetrically so that each linear array of radiating elements included in the antenna will see approximately the same amount of RF energy focusing material. For example, in some embodiments, a single heat dissipation element may be included that passes through the center of the RF lens, while in other embodiments, the number of heat dissipation elements may be equal to the number of linear arrays included in the antenna or an integer multiple thereof.

The base station antennas according to embodiments of the present inventive concept may be multibeam antennas that can be used for sector-splitting applications. In some embodiments, these multibeam base station antennas may include at least first and second arrays of radiating elements that are configured to operate in the same frequency band and an RF lens that is positioned to receive electromagnetic radiation from the first and second arrays. At least one heat dissipation channel extends through RF energy focusing material of the RF lens.

In other embodiments, the multibeam base station antennas may include at least first and second arrays of radiating elements that are configured to operate in the same frequency band and that generate respective first and second antenna beams that have azimuth boresight pointing directions that extend along respective first and second vectors. These antennas further include an RF lens that is positioned to receive electromagnetic radiation from the first and second arrays of radiating elements, the RF lens including an RF energy focusing material and a heat dissipation element. The first and second linear arrays are positioned so that the first and second vectors intersect the heat dissipation element.

In still other embodiments, the multibeam base station antennas may include a housing that has a radome and a bottom end cap, as well as an array of radiating elements and an RF lens that are both mounted within the housing. The RF lens is positioned to receive electromagnetic radiation from the array of radiating elements. The RF lens includes an outer shell, an RF energy focusing material within the outer shell, and a plurality of heat dissipation channels that extend through the RF energy focusing material. A first of the heat dissipation channels extends outside of the RF lens and through the bottom end cap of the housing.

In still other embodiments, the multibeam base station antennas may include an RF lens that is positioned to receive electromagnetic radiation from a radiating element. The RF lens includes an RF energy focusing material and one or more heat dissipation channels that extend through the RF energy focusing material. The heat dissipation channel(s) may contain a cooling fluid and, in some embodiments, may further include an air or lattice filled chamber in addition to the cooling fluid.

In still other embodiments, the multibeam base station antennas may include a plurality of linear arrays of radiating elements that are configured to generate a plurality of RF beams, respectively. Each of the plurality of RF beams may have an associated radiation profile. An RF lens including an RF energy focusing material configured to receive the plurality of RF beams. The base station antennas may further include one or more heat dissipation channels that contain a fluid and extend through the RF energy focusing material. Each of these heat dissipation channel(s) may be positioned in the RF lens so as to intersect with one or more of the radiation profiles.

In still other embodiments, the multibeam base station antennas may include a plurality of radiating elements that are configured to generate a plurality of RF beams. An RF lens including an RF energy focusing material may be configured to receive the plurality of RF beams. One or more cooling fluid containing heat dissipation channels may extend through the RF energy focusing material of the RF lens. A condenser may be coupled to the heat dissipation channel(s), which may be configured to receive the cooling fluid therethrough so as to facilitate circulation of the cooling fluid therebetween.

Embodiments of the present inventive concept will now be discussed in greater detail with reference to the attached figures, in which example embodiments are shown.

Figure 1B:
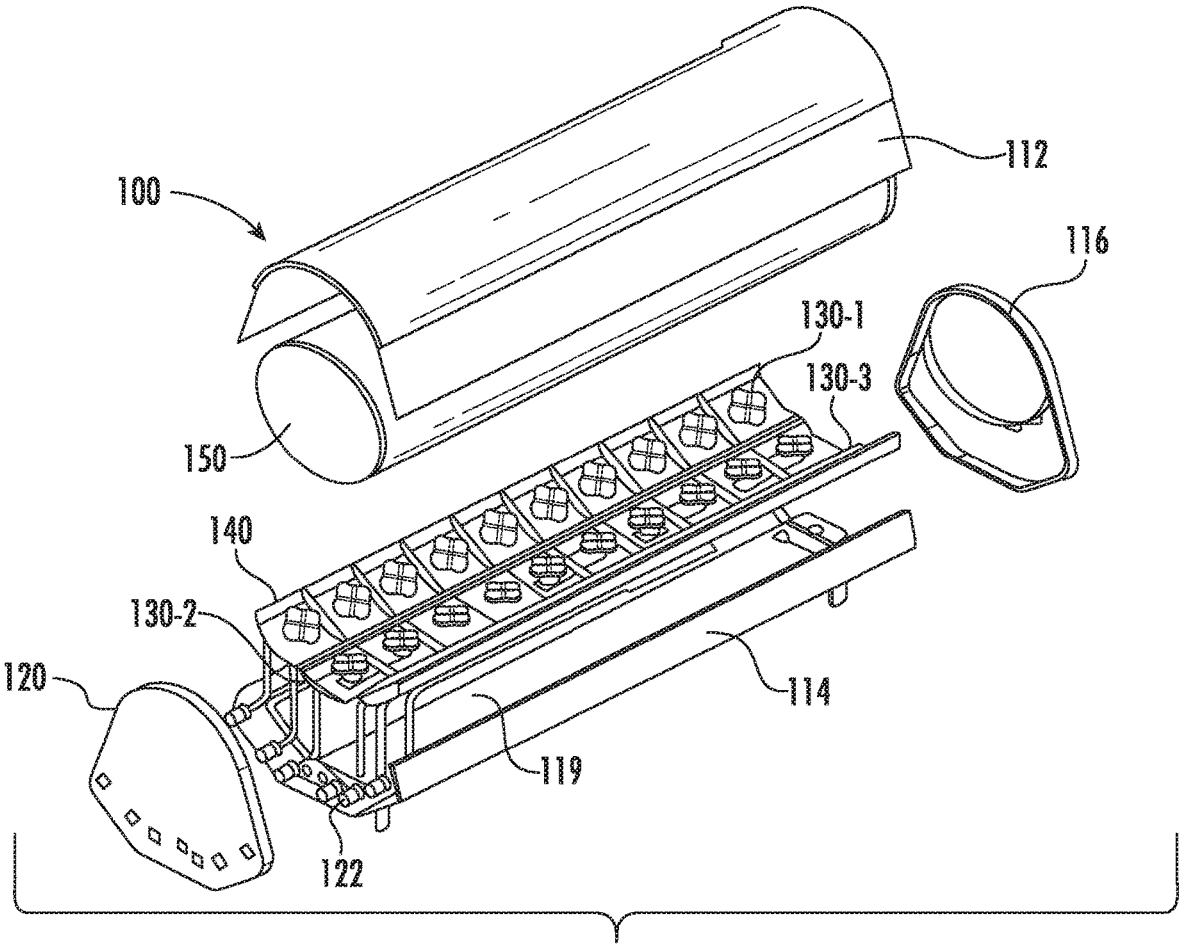
FIG. 1B is an exploded perspective view of the lensed base station antenna of FIG. 1A.
Figure 1C:
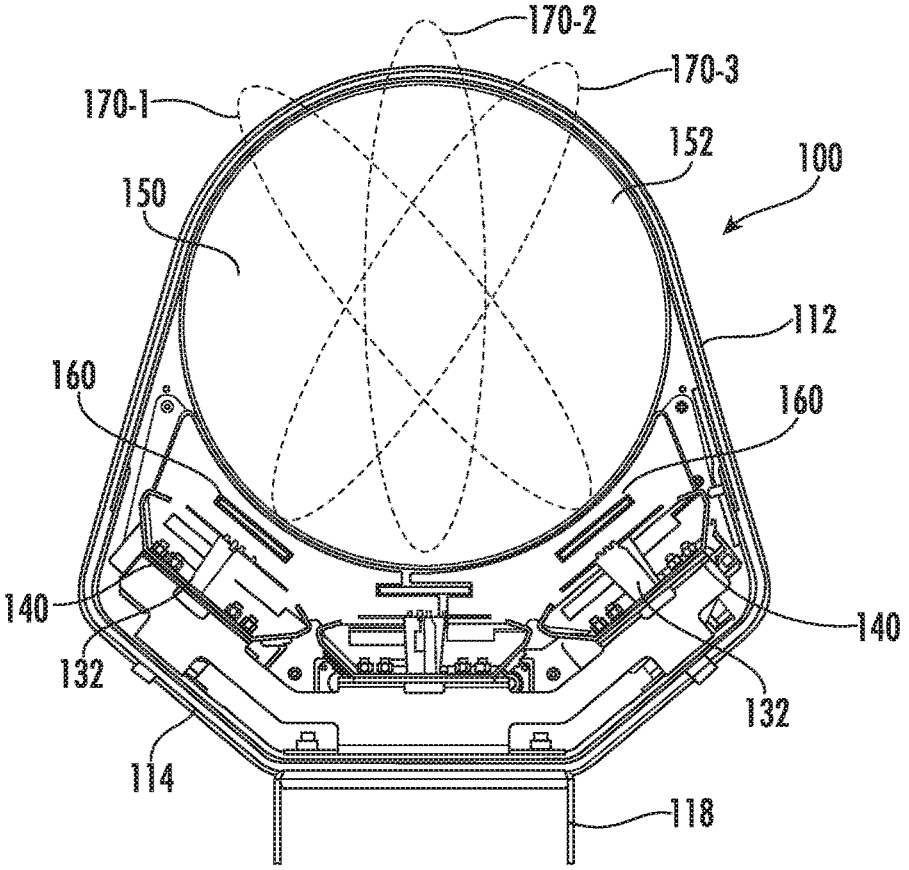
FIG. 1C is a transverse cross-sectional view of the base station antenna of FIGS. 1A-1B illustrating the antenna beams formed thereby.
Figure 1D:
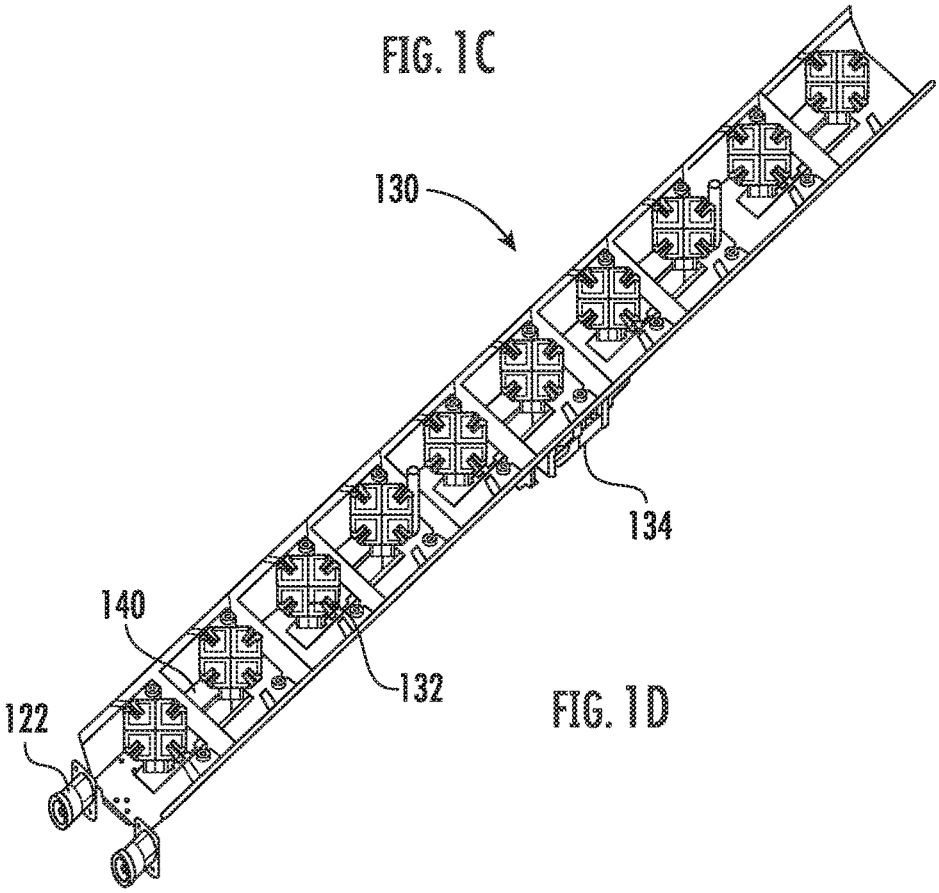
FIG. 1D is an enlarged perspective view of one of the linear arrays of radiating elements illustrated in FIG. 1B.
Figure 1E:
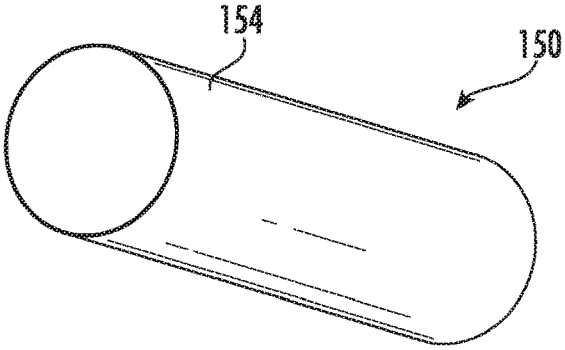
FIG. 1E is a perspective view of the RF lens illustrated in FIGS. 1B-1C.
Figure 1F:
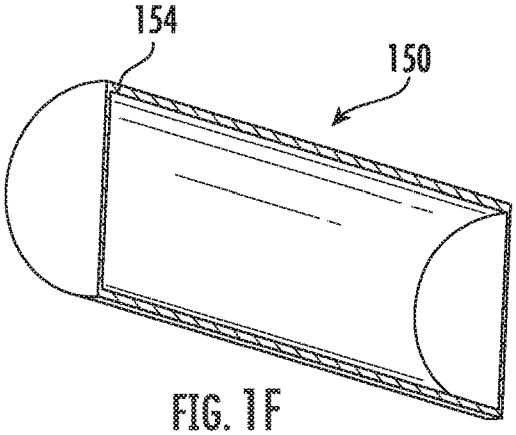
FIG. 1F is a cross-sectional view of the RF lens of FIG. 1E with the RF energy focusing material of the RF lens omitted.

Reference is now made to FIGS. 1A-1F, which illustrate a conventional lensed multibeam base station antenna 100. In particular, FIGS. 1A and 1B are a perspective view and an exploded perspective view, respectively, of a lensed multibeam base station antenna 100. FIG. 1C is a transverse cross-sectional view of the base station antenna 100, and FIG. 1D is a perspective view of one of the linear arrays of radiating elements illustrated in FIGS. 1B-1C. Finally, FIG. 1E is a perspective view of the RF lens illustrated in FIGS. 1B-1C, and FIG. 1F is a cross-sectional view of the RF lens of FIG. 1E with the RF energy focusing material of the RF lens omitted.

Referring first to FIGS. 1A-1B, the lensed multibeam base station antenna 100 includes a housing 110. In the depicted embodiment, the housing 110 is a multi-piece housing that includes a radome 112, a tray 114, a top end cap 116 and a bottom end cap 120. Brackets 118 are mounted on the rear side of the tray 114 that may be used to mount the antenna 100 on an antenna mount structure. A plurality of RF ports 122 and control ports 124 may be mounted in the bottom end cap 120. The RF ports 122 may comprise RF connectors that may receive coaxial cables that provide RF connections between the base station antenna 100 and one or more radios (not shown). The control ports 124 may comprise connectors that receive control cables that may be used to send control signals to the antenna 100.

The radome 112, end caps 116, 120 and tray 114 may provide physical support and environmental protection to the antenna 100. The end caps 116, 120, radome 112 and tray 114 may be formed of, for example, extruded plastic, and may be multiple parts or implemented as a single piece. For example, the radome 112 and the top end cap 116 may be implemented as a monolithic element. In some embodiments, an RF absorber 119 can be placed between the tray 114 and the radiating elements 132 (discussed below). The RF absorber 119 may help reduce passive intermodulation ("PIM") distortion that may be generated because the metal tray 114 and a metal reflector 140 (discussed below) may create a resonant cavity that generates PIM distortion. The RF absorber 119 may also provide back lobe performance improvement.

Referring to FIGS. 1B-1D, the base station antenna 100 further includes one or more linear arrays 130-1, 130-2, and 130-3 of radiating elements 132. Herein, when multiple of the same elements are included in an antenna the elements may be referred to individually by their full reference numeral (e.g., linear array 130-3) and collectively by the first part of their reference numerals (e.g., the linear arrays 130). Each linear array 130 includes a plurality of radiating elements 132. While the radiating elements 132 included in each linear array 130 are illustrated in FIGS. 1B-1D as cross-polarized "box" dipole radiating elements 132 that have four dipole arms mounted on feed stalk printed circuit boards that form a pair of slant −45°/+45° dipole radiators that emit RF energy with −45° and +45° polarizations, respectively, it will be appreciated that any appropriate radiating elements 132 may be used. For example, single polarization dipole radiating elements or patch radiating elements may be used in other embodiments.

While the antenna 100 includes three linear arrays 130, it will be appreciated that different numbers of linear arrays 130 may be used. For example, two or four linear arrays 130 may be used in other embodiments. It will also be appreciated that the antenna 100 may include additional linear arrays of radiating elements (not shown) that operate in different frequency bands. For example, additional linear arrays could be interleaved with the linear arrays 130 as shown, for example, in U.S. Pat. Nos. 7,405,710 9,819,094, both of which are incorporated herein by reference. This approach allows the lensed antenna to operate in two different frequency bands (for example, 790-960 MHz and 1.7-2.7 GHz).

Since the antenna 100 includes cross-polarized radiating elements 132, each linear array 130 may generate two antenna beams 170, namely an antenna beam 170 at each of the two polarizations. Three antenna beams 170-1, 170-2, 170-3 that are generated by the respective linear arrays 130-1, 130-2, 130-3 are illustrated schematically in FIG. 1C. Only three antenna beams 170 are illustrated in FIG. 1C as the two antenna beams 170 formed at orthogonal polarizations by each linear array 130 may have substantially identical shapes and pointing directions. The centers of the antenna beams 170 formed by each linear array 130 are pointed at azimuth angles of −40°, 0°, and 40°, respectively. Thus, the three linear arrays 130 generate antenna beams 170 that together provide coverage to a 120° region in the azimuth plane.

Each linear array 130 may be mounted to extend forwardly from a reflector 140. In the depicted embodiment, each linear array 130 includes a separate reflector 140, although it will be appreciated that a monolithic reflector 140 that serves as the reflector for all three linear arrays 130 may be used in other embodiments. Each reflector 140 may comprise a metallic sheet that serves as a ground plane for the radiating elements 132 and that also redirects forwardly much of the backwardly-directed radiation emitted by the radiating elements 132. As shown in FIG. 1D, each linear array 130 may further include an associated phase shifter/divider 134. The divider portion of each phase shifter/divider 134 may divide an RF signal in the transmit path into a plurality of sub-components (and may combine a plurality of received sub-components of an RF signal in the receive path). The phase shifter portion of the phase shifter/divider 134 may be used to inject a phase taper across the sub-components of the RF signal in order to change the elevation angle of the resulting antenna beam in a desired fashion. One or more phase shifter/dividers 134 may be provided for each linear array 130. As is further shown in FIG. 1D, two of the RF connectors 122 may be used to pass signals between each linear array 130 and a radio (not shown), namely an RF signal for each of the two orthogonal polarizations.

The antenna 100 further includes an RF lens 150. The RF lens 150 may be positioned in front of the linear arrays 130 so that the apertures of the linear arrays 130 point at a center axis of the RF lens 150. In some embodiments, each linear array 130 may have approximately the same length as the RF lens 150. When the antenna 100 is mounted for use, the azimuth plane is generally perpendicular to the longitudinal axis of the RF lens 150, and the elevation plane is generally parallel to the longitudinal axis of the RF lens 150.

The RF lens 150 may comprise or include an RF energy focusing material 152. In some embodiments, the RF energy focusing material 152 may be a dielectric material that has a generally homogeneous dielectric constant. The RF lens 150 may be formed of the RF energy focusing material 152 or may comprise a container 154 (e.g., a hollow, lightweight shell) that is filled with the RF energy focusing material 152. The container/shell 154 may also be formed of a dielectric material and the container/shell 154 may also contribute to the focusing of the RF energy. In an example embodiment, the RF lens 150 may comprise a circular cylindrical shell 154 that includes a dielectric material 152 having a generally uniform dielectric constant. In other embodiments, the RF lens 150 may comprise a Luneburg lens that includes multiple layers of dielectric materials that have different dielectric constants. A cylindrical lens 150 may focus RF energy in the azimuth plane while defocusing RF energy in the elevation plane. While the RF lens 150 comprises a circular cylinder, it will be appreciated that the RF lens 150 may have other shapes including a spherical shape, an ellipsoid shape, an elliptical cylinder shape and the like, and that more than one RF lens 150 may be included in the antenna 100.

The RF energy focusing material 152 included in the RF lens 150 may be a conventional lightweight dielectric material such as polystyrene, expanded polystyrene, polyethylene, polypropylene, expanded polypropylene, or a so-called "artificial" or "composite" dielectric material that include metals, metal oxides or high dielectric constant dielectric materials such as certain ceramic powders that have the electromagnetic properties of high dielectric constant materials. Both types of material are referred to as "dielectric materials" herein. The RF energy focusing material may comprise, for example, any of the composite dielectric materials that are disclosed in U.S. patent application Ser. No. 15/882,505, filed Jan. 29, 2018, the entire content of which is incorporated herein by reference.

The RF lens 150 may shrink the 3 dB beamwidth of each antenna beam 170-1, 170-2, 170-3 (see FIG. 1C) output by each linear array 130 from about 65° to about 23° in the azimuth plane. By narrowing the azimuth beamwidth of each antenna beam 170, the RF lens 150 increases the gain of each antenna beam 170 by, for example, about 4-5 dB. The higher antenna gains allow the multibeam base station antenna 100 to support higher data rates at the same quality of service. The multibeam base station antenna 100 may also reduce the antenna count at a tower or other mounting location.

The use of a cylindrical lens such as RF lens 150 may reduce grating lobes (and other far sidelobes). The reduction in grating lobes may allow for increased spacing between adjacent radiating elements 132, potentially allowing for a 20-30% reduction in the number of radiating elements included in each linear array 130, as is explained in U.S. Pat. No. 9,819,094.

As is further shown in FIG. 1C, the multibeam base station antenna 100 may also include one or more secondary lenses 160. A secondary lens 160 can be placed between each linear array 130 and the RF lens 150. The secondary lenses 160 may facilitate azimuth beamwidth stabilization. The secondary lenses 160 may be formed of dielectric materials and may be shaped as, for example, rods, cylinders or cubes.

As discussed above, one difficulty with RF lenses is that some of the RF energy that is injected into the RF lens will be converted to heat which may raise the temperature of the RF energy focusing material. Highly specialized RF energy focusing materials may be used in RF lenses in order to provide relatively small, lightweight and preferably relatively inexpensive RF lenses. Unfortunately, some of these specialized RF energy focusing materials may have very low levels of thermal conductivity, and hence heat may build up in the RF lens. This can potentially be a significant problem in cases where the base station antenna is operated at maximum power for extended periods of time, as the amount of temperature increase in such situations may be dramatic. The electromagnetic properties of dielectric materials may change at elevated temperatures, and if the temperatures are high enough, the dielectric material may even be permanently damaged.

Pursuant to embodiments of the present inventive concept, base station antennas are provided that include RF lenses having heat dissipation elements, such as air channels, that may be used to vent heat from the interior of the RF lens. These antennas may also include active cooling elements such as small fans which may further assist with the removal of heat from the RF lenses. The heat dissipation elements may be used to maintain the temperature of the RF energy focusing material of the RF lens below levels where the material is damaged or at which the electromagnetic properties of the RF energy focusing material is altered in a manner that materially impacts the performance of the RF lens. RF lenses that include the heat dissipation elements according to embodiments of the present inventive concept may be operated at higher power levels without compromising RF performance. Moreover, the size, constitution and placement of the heat dissipation elements may be selected to improve characteristics of the antenna patterns generated by the antennas, such as the azimuth sidelobe levels.

Figure 2A:
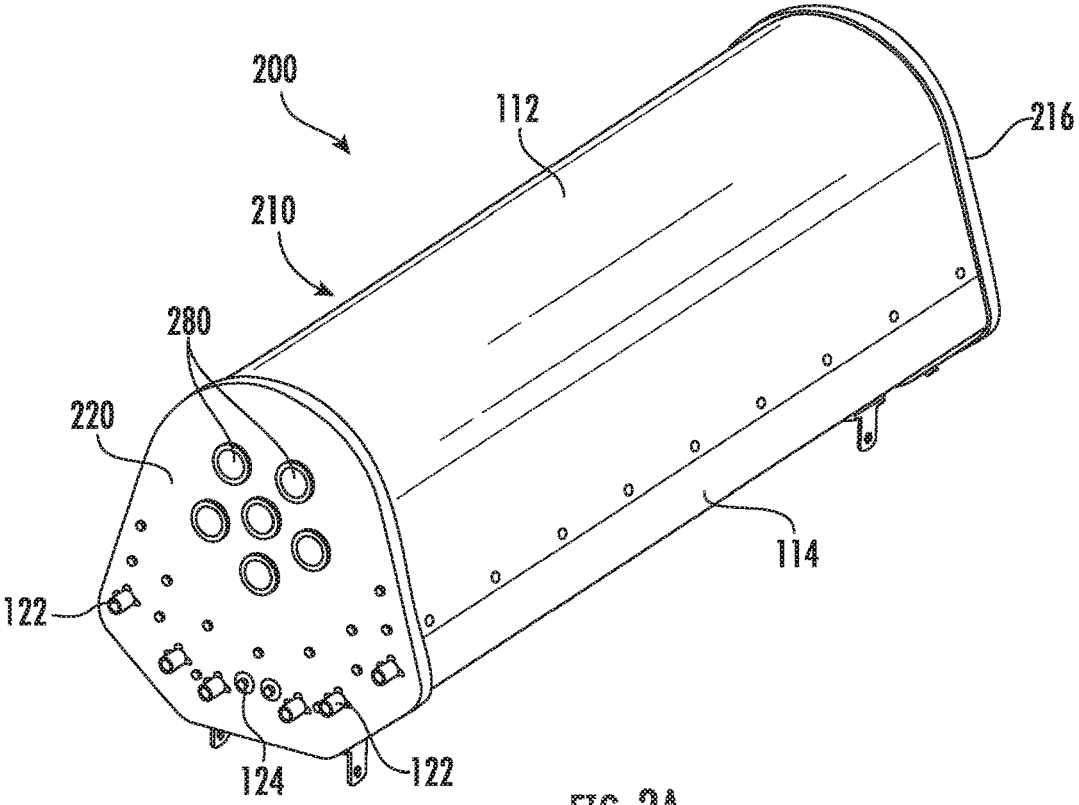
FIG. 2A is a perspective view of a lensed base station antenna according to some embodiments of the inventive concept.
Figure 2B:
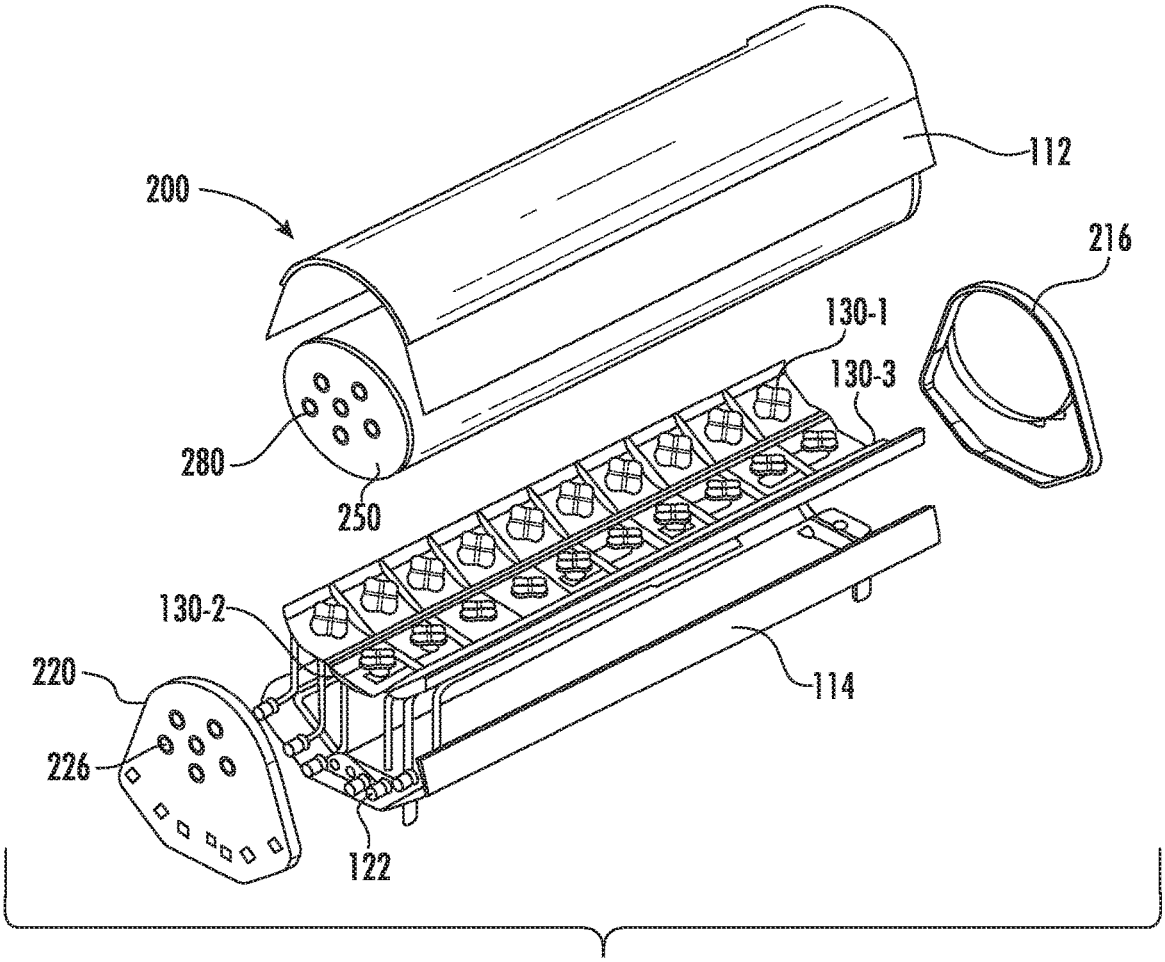
FIG. 2B is an exploded perspective view of the lensed base station antenna of FIG. 2A according to some embodiments of the inventive concept.
Figure 2C:
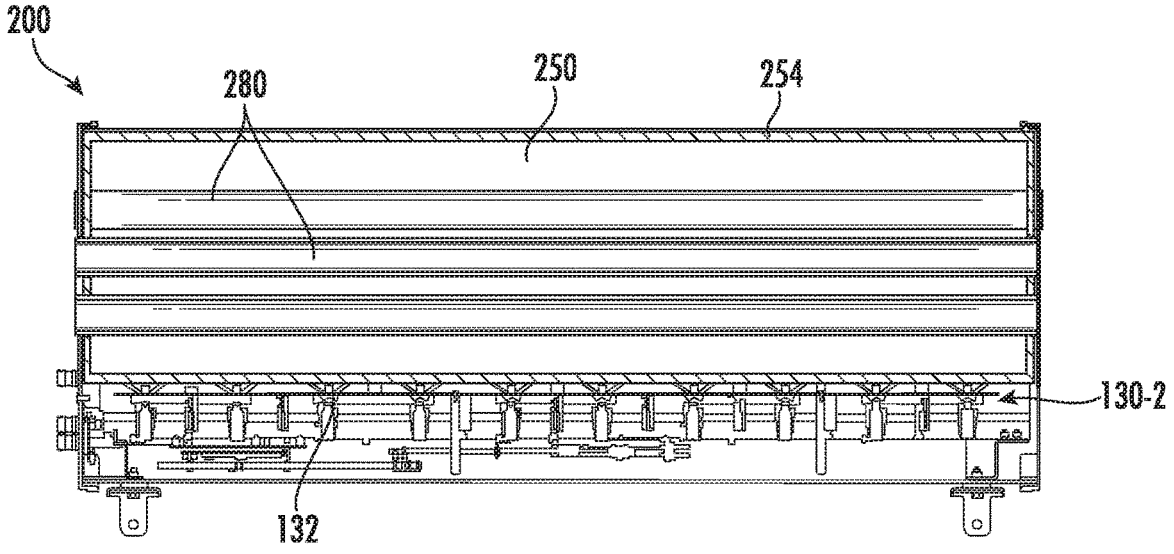
FIG. 2C is a longitudinal cross-sectional view of the base station antenna of FIGS. 2A-2B according to some embodiments of the inventive concept.
Figure 2D:
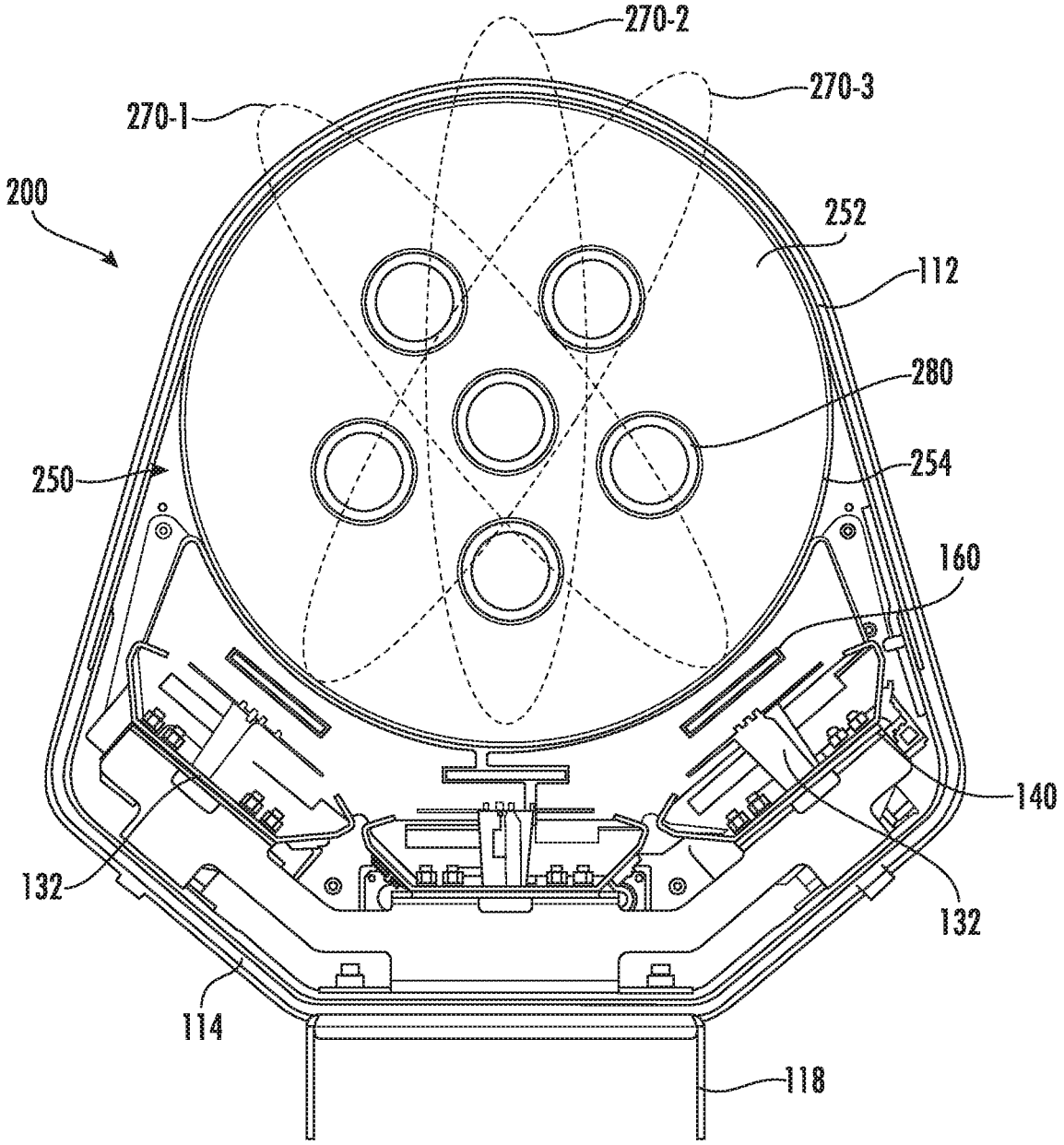
FIG. 2D is a transverse cross-sectional view of the base station antenna of FIGS. 2A-2B illustrating the antenna beams formed thereby according to some embodiments of the inventive concept.
Figure 2E:
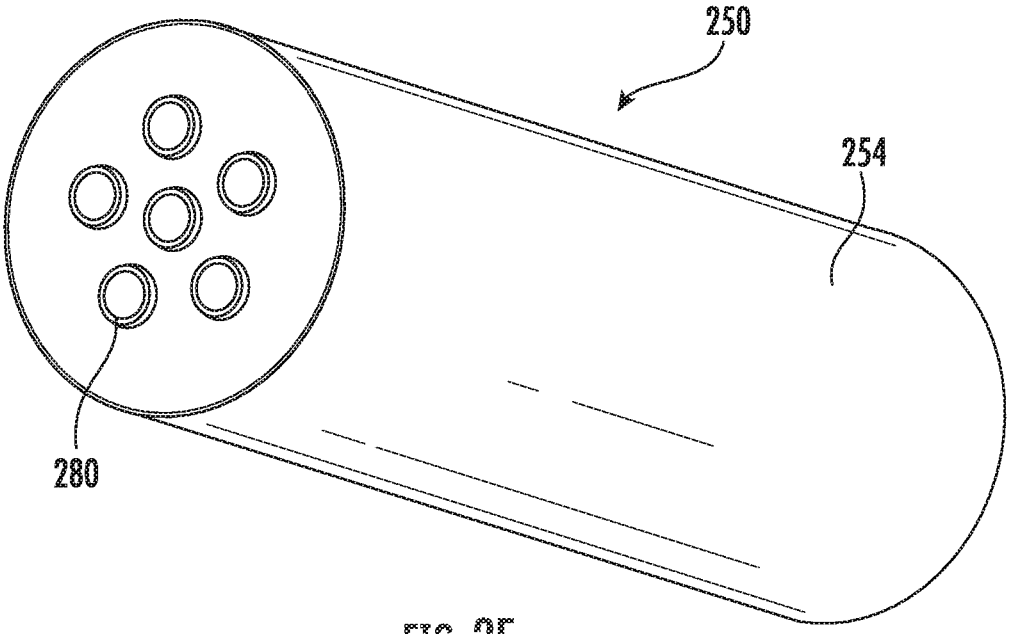
FIG. 2E is a perspective view of the RF lens illustrated in FIGS. 2B-2D according to some embodiments of the inventive concept.
Figure 2F:
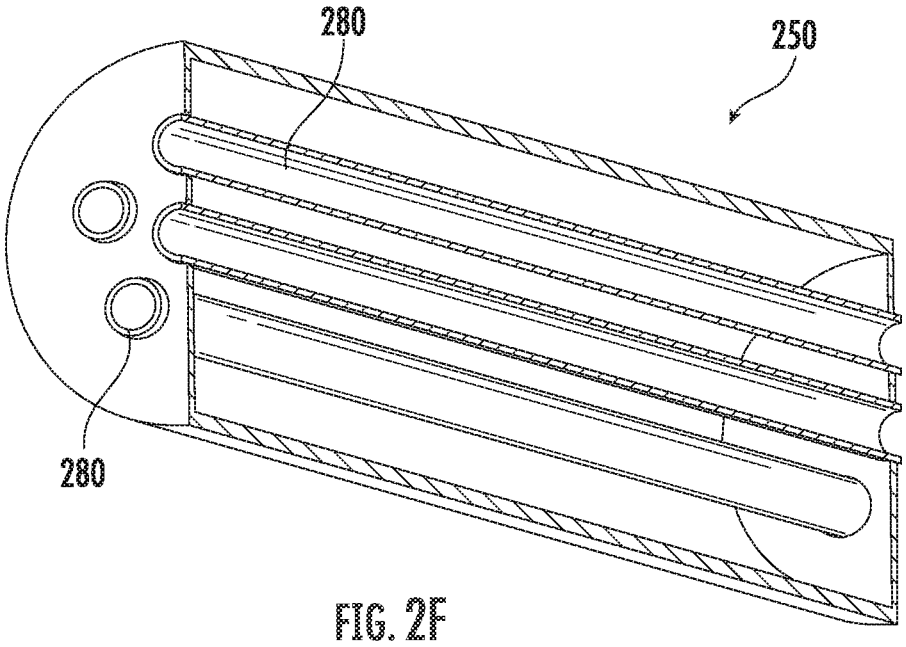
FIG. 2F is a cross-sectional view of the RF lens of FIG. 2E with the RF energy focusing material of the RF lens omitted according to some embodiments of the inventive concept.

FIGS. 2A-2F illustrate a multibeam lensed antenna 200 according to embodiments of the present inventive concept. In particular, FIGS. 2A and 2B are a perspective view and exploded perspective view, respectively, of the lensed base station antenna 200, while FIGS. 2C and 2D are respective longitudinal and transverse cross-sectional views thereof. FIG. 2E is a perspective view of the RF lens 250 included in the antenna 200, and FIG. 2F is a cross-sectional view of the RF lens 250 with the RF energy focusing material filler of the RF lens 250 omitted. The multibeam lensed antenna 200 may be similar to the multibeam lensed antenna 100 discussed above with reference to FIGS. 1A-1F, except that the RF lens 250 included in multibeam lensed antenna 200 may include one or more heat dissipation elements. In light of the similarities between antennas 100 and 200, the discussion below will focus on the differences between the two antennas.

The antenna 200 includes a housing 210. The housing 210 includes a radome 112, a tray 114 a top end cap 216 and a bottom end cap 220. The antenna 200 further includes three linear arrays 130 of radiating elements 132 that are mounted on respective reflectors 140. The radome 112, a tray 114, linear arrays 130, radiating elements 132, and reflectors 140 may be identical to the like numbered elements included in antenna 100, and hence further discussion of these elements of antenna 200 will be omitted.

As shown in FIG. 2A, the base station antenna 200 may include a plurality of heat dissipation channels 280. In the antenna 200, each heat dissipation channel comprises a heat dissipation pipe 280 that is formed of a dielectric material such as plastic that extends through the RF lens 250. The heat dissipation pipes 280 may also extend through openings 226 in the bottom end cap 220 so that heat dissipation pipes 280 are open to the environment at the bottom of the antenna 200. While not visible in the drawings, the top end cap 216 may include similar openings 226 so that the heat dissipation pipes 280 may also extend through the top end cap 216. While the top end cap 216 and the radome 112 are shown as separate elements in FIGS. 2A-2C, it will be appreciated that in other embodiments they may be implemented together as a monolithic element. Waterproofing seals (not shown) may be included in one or both of the bottom end cap 220 and the top end cap 216 so that water or moisture cannot leak into the interior of the antenna 200 through the openings 226 in the end caps 216, 220 for the heat dissipation pipes 280. Having the heat dissipation pipes 280 extend all the way through the antenna 200 allows air to readily flow through the heat dissipation pipes 280 in order to vent heat from the interior of the RF lens 250.

As can best be seen in FIGS. 2B-2D, the heat dissipation pipes 280 extend vertically through the RF lens 250. As such, heat that builds up within the interior of the RF lens 250 may pass into the heat dissipation pipes 280 and be vented from the antenna 200 by the flow of air through the heat dissipation pipes 280. While the RF lens 250 is shown as including a total of six heat dissipation pipes 280 passing therethrough, it will be appreciated that the number of heat dissipation pipes 280 used may be varied.

FIG. 2D is a transverse cross-section through the base station antenna 200 that schematically illustrates the antenna beams 270 formed by the three liner arrays 130 of radiating elements 132 included in antenna 200. The linear arrays 130 and radiating elements 132 may be identical to the like numbered elements included in antenna 100, and hence further discussion of these elements of antenna 200 will be omitted.

As shown in FIG. 2D, all three of the antenna beams 270 pass through the longitudinal axis of the RF lens 250. As the RF energy that generates the antenna beams 270 is the cause of the heating of the RF energy focusing material 252 included in RF lens 250, significant heat may build up in the center of the RF lens 250. As shown in FIG. 2D, a first of the heat dissipation pipes 280 may extend along the longitudinal axis of the RF lens 250 and hence may be well-located to vent heat from the central region of the RF lens 250. The second through sixth five heat dissipation pipes 280 are arranged to define a pentagon that surrounds the first heat dissipation pipe 280.

As can further be seen in FIG. 2D, a total of three linear arrays 130 and six heat dissipation pipes 280 are provided. Thus, the number of heat dissipation pipes 280 is an integer multiple of the number of linear arrays 130. Such a correspondence may be advantageous as it may allow the heat dissipation pipes 280 to be arranged generally symmetrically with respect to the linear arrays, which may ensure that the heat dissipation pipes have the same or similar impacts on each of the antenna beams 270.

As can also be seen in FIG. 2D, the three antenna beams 270 each intersect the central heat dissipation pipe 280. As such, the central heat dissipation pipe 200 is located in a region that may be particularly susceptible to heat build-up within the antenna 200. It may also be noted that each antenna beam has an azimuth boresight pointing direction that extends along a respective vector, and that all three vectors intersect at a common point within the heat dissipation element.

While the heat dissipation pipes 280 are illustrated in FIGS. 2A-2F as having circular transverse cross-sections, it will be appreciated that embodiments of the present inventive concept are not limited thereto. For example, in other embodiments the heat dissipation pipes 280 may have square, hexagonal, elliptical or other transverse cross-sections. Moreover, while the heat dissipation pipes 280 extend all the way through the antenna 200 in the depicted embodiment, in other embodiments, the heat dissipation pipes 280 may only extend through the bottom end cap 220 and not through the top end cap 216, which may enhance the waterproofing performance of the antenna 200. In still other embodiments, the heat dissipation pipes 280 may not extend through either the bottom end cap 220 or the top end cap 216, but instead may be completely enclosed within the antenna 200. This may further enhance the waterproofing performance of the antenna 200 and protect against infestation by wildlife such as birds and insects. In some such embodiments, only a very thin, waterproof covering may separate the heat dissipation pipes 280 from the exterior of the antenna 200 in order to allow heat to readily dissipate from the heat dissipation pipes 280 to the environment.

Figure 2G:
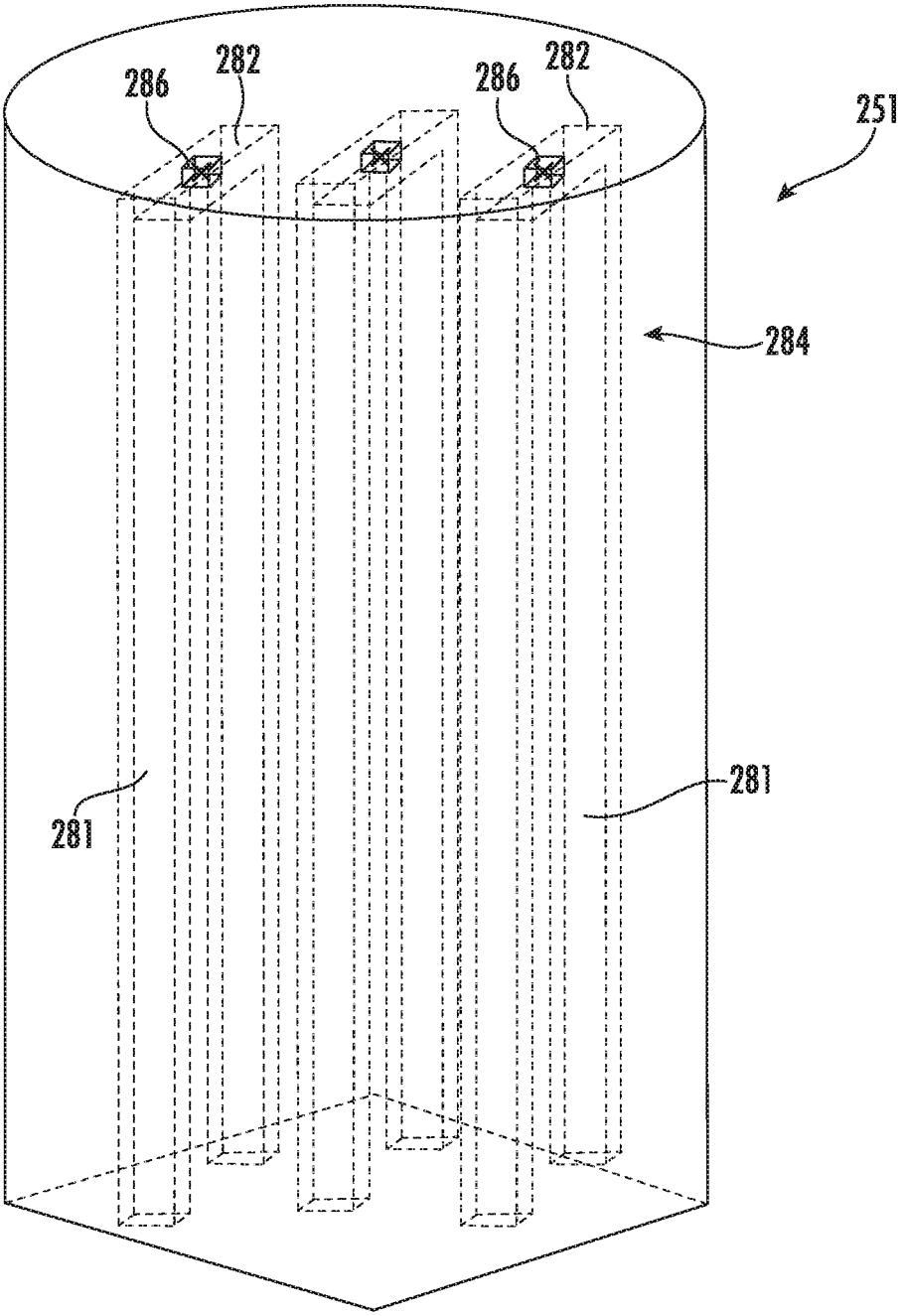
FIG. 2G is a schematic perspective view of an RF lens according to some embodiments of the inventive concept.

FIG. 2G is a schematic perspective view of a modified version 251 of the RF lens 250. The RF lens 251 includes heat dissipation pipes 281 that are configured so that they will only extend through the bottom end cap of an associated base station antenna and not through a top end cap thereof. The heat dissipation pipes 281 have rectangular transverse cross-sections as opposed to the circular transverse cross-sections of heat dissipation pipes 280 of antenna 200. As is schematically shown in FIG. 2G, in such an embodiment, the heat dissipation pipes 281 may be joined in pairs by connecting members 282. The connecting members 282 may be located near the top of the RF lens 251 and may connect the top of one heat dissipation pipe 281 to the top of another heat dissipation pipe 281 to form a U-shaped heat dissipation element 284. The bottom ends of each heat dissipation pipe 281 may extend outside or otherwise be open to the outside of the antenna. The heat dissipation pipe design shown in FIG. 2G may be less efficient in venting heat, but may have superior waterproofing qualities, as water ingress through openings 226 in an end cap 220 at the bottom of an antenna is much less likely than water ingress through openings 226 in a top end cap 216 of an antenna. To improve heat removal, small electric fans 286 may be positioned within the connecting members 282 (or elsewhere in the U-shaped heat dissipation elements 284) to increase ambient air flow through each heat dissipation element 284 to more efficiently vent the heat from the RF lens 251. In some embodiments, the electric fans 286 may be controlled so that they only turn on in response to a temperature sensor that is within the antenna exceeding a pre-set threshold.

The heat dissipation pipes 280 may be formed of any suitable material. For example, the heat dissipation pipes 280 may be formed using PVC pipes having, for example, sidewalls of between ⅛ and ¼ of an inch thick. Numerous other materials may be used. Preferably, the heat dissipation pipes 280 are formed of a lightweight dielectric material that will not significantly impact the RF performance of the antenna 200. In embodiments where the heat dissipation pipes 280 extend all the way through the antenna 200 (and, in particular, in embodiments where the heat dissipation pipes 280 extend through the top end cap 216), it may be preferable that the pipes be impervious to water and moisture, as water may readily flow through the heat dissipation pipes 280.

It will also be understood that the cross-sectional area of the heat dissipation pipes 280 may be varied from what is shown. Generally speaking, a larger number (e.g., 4 or more) of small heat dissipation pipes 280 may be preferred over a smaller number of heat dissipation pipes 280 (e.g., 1-3) as this may allow the maximum distance between the RF energy focusing material and the closest heat dissipation pipe 280 to be reduced. The heat dissipation pipes 280 may also be clustered in the regions of the RF lens 250 that receive the most RF radiation, which generally are the longitudinal axis extending through the center of the RF lens 250 and the portions of the RF lens 250 that are right in front of the linear arrays 130. Moreover, while the heat dissipation pipes 280 may improve the performance of the antenna 200 by venting heat from the RF lens 250 that can change the RF energy focusing properties of the RF lens 250, it will be understood that the heat dissipation pipes 280 displace RF energy focusing material within the RF lens 250 and hence change the focusing characteristics of the RF lens 250. Thus, tradeoffs exist regarding the size, number and location of the heat dissipation pipes 280 or other heat dissipation elements 280.

FIGS. 3A-6B show simulation results that illustrate these tradeoffs. In particular, FIGS. 3A, 4A, 5A and 6A are cross-sectional views of RF lenses having four different arrangements of heat dissipation pipes 280, while FIGS. 3B, 4B, 5B and 6B are graphs showing the simulated azimuth patterns for the antenna beams generated by linear array 130-2 in base station antennas having the design of base station antenna 200 that include the four example lenses shown in FIGS. 3A, 4A, 5A and 6A.

Figure 3A:
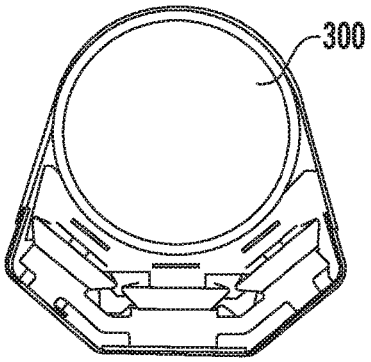
FIG. 3A is a transverse cross-sectional view of the base station antenna of FIG. 1A according to some embodiments of the inventive concept.
Figure 3B:
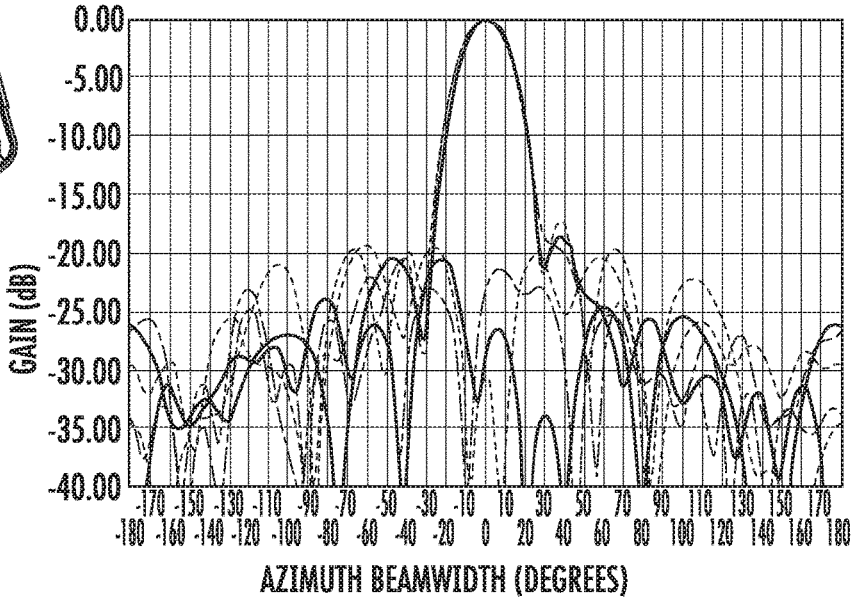
FIG. 3B is a graph illustrating the azimuth pattern of the center linear array of the antenna of FIG. 3A according to some embodiments of the inventive concept.

FIG. 3A illustrates an RF lens 300 that does not include any heat dissipation channels 280, and hence may be identical to the RF lens 150 included in base station antenna 100 of FIGS. 1A-1F. FIG. 3B illustrates the azimuth pattern for one of the linear arrays 130 of base station antenna 100 (or 200) when used with the RF lens 300. The graph of FIG. 3A serves as a baseline for the azimuth pattern.

Figure 4A:
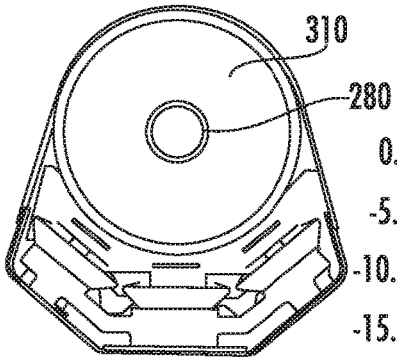
FIG. 4A is a transverse cross-sectional view of a base station antenna according to some embodiments of the inventive concept.
Figure 4B:
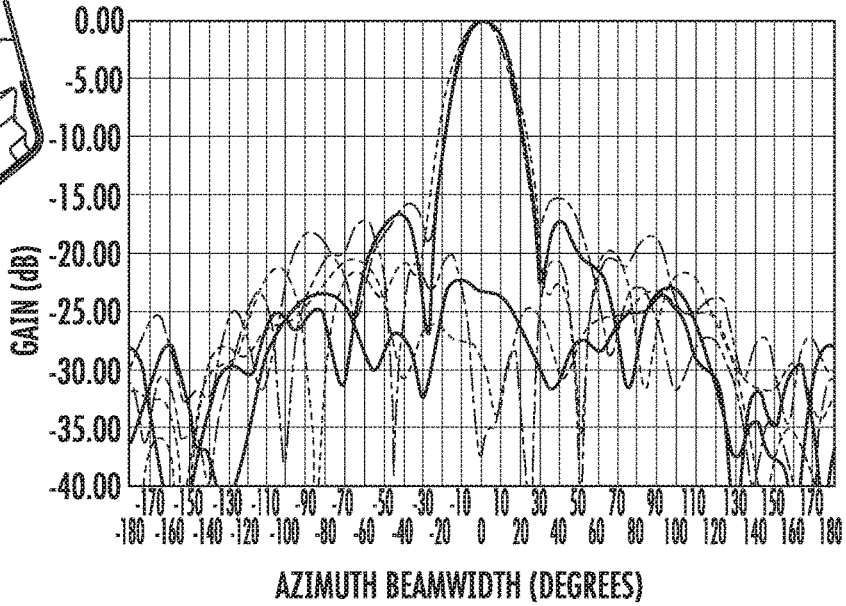
FIG. 4B is a graph illustrating the azimuth pattern of the center linear array of the antenna of FIG. 4A according to some embodiments of the inventive concept.

FIG. 4A illustrates an RF lens 310 that includes a single, large (3 inch outer diameter, 2.5 inch inner diameter) heat dissipation pipe 280 that extends along the longitudinal axis of the RF lens 310. FIG. 4B illustrates the azimuth pattern for one of the linear arrays 130 of base station antenna 200 when used with the RF lens 310. As can be seen by comparing FIGS. 3B and 4B, the main lobe of the azimuth pattern is wider in FIG. 4B, indicating that the RF lens 310 performs less focusing of the RF energy, which is a natural result of replacing the RF energy focusing material in the middle of the RF lens 310 with a heat dissipation pipe 280. Additionally, the addition of the heat dissipation pipe 280 results in a significant increase in the near sidelobe levels (greater than 3 dB), as well as similar increases in the levels of the sidelobes that are farther removed from the main lobe. The azimuth pattern shown in FIG. 4B would typically be considered to be significantly degraded as compared to the azimuth pattern of FIG. 3B. Some of the negative features of the azimuth pattern of FIG. 4B could be reduced or eliminated by, for example, increasing the diameter of the RF lens 310, but this change has other associated costs in terms of cost, weight, size and the like.

Figure 5A:
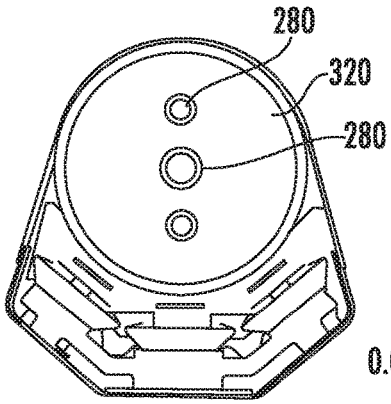
FIG. 5A is a transverse cross-sectional view of a base station antenna according to some embodiments of the inventive concept.
Figure 5B:
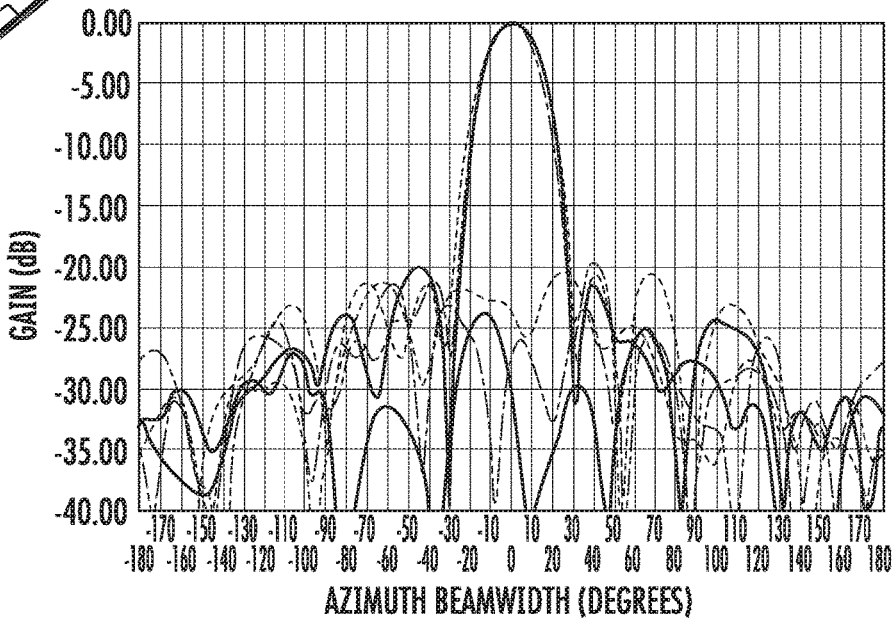
FIG. 5B is a graph illustrating the azimuth pattern of the center linear array of the antenna of FIG. 5A according to some embodiments of the inventive concept.

FIG. 5A illustrates an RF lens 320 that includes a single, mid-sized (2 inch outer diameter, 1.5 inch inner diameter) heat dissipation pipe 280 that extends along the longitudinal axis of the RF lens 320 as well as two smaller (1.5 inch outer diameter, 1.0 inch inner diameter) vertically-extending heat dissipation pipes 280 that are aligned along the azimuth boresight pointing direction of linear array 130-2 on either side of the mid-sized heat dissipation pipe 280. FIG. 5B illustrates the azimuth pattern for linear array 130-2 of base station antenna 200 when used with the RF lens 320. As can be seen by comparing FIGS. 3B and 5B, the main lobe FIG. 5B is not materially changed from the main lobe shown in FIG. 3B, which result is slightly non-intuitive, but tends to indicate that the amount of RF energy focusing material that was removed to allow for inclusion of the heat dissipation pipes 280 did not have a material impact on the ability of the RF lens 320 to focus the RF energy. Additionally, the side lobe levels are comparable to, or perhaps even slightly reduced, from the baseline sidelobe levels shown in FIG. 3B. Thus, the RF lens 320 has good performance characteristics. However, the azimuth patterns for linear arrays 130-1 and 130-3 will differ from that shown in FIG. 5B due to the asymmetrical design of RF lens 320 with respect to the three linear arrays 130, and the small number of relatively small heat dissipation pipes 280 will remove less heat from RF lens 320 than other designs, particularly in regions of the RF lens 320 where linear arrays 130-1 and 130-3 will inject large amounts of RF energy. Thus, it is anticipated that RF lens 320 will have a relatively reduced ability to vent heat generated within the RF lens 320.

Figure 6A:
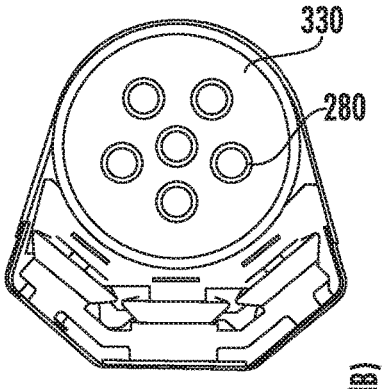
FIG. 6A is a transverse cross-sectional view of a base station antenna according to some embodiments of the inventive concept.
Figure 6B:
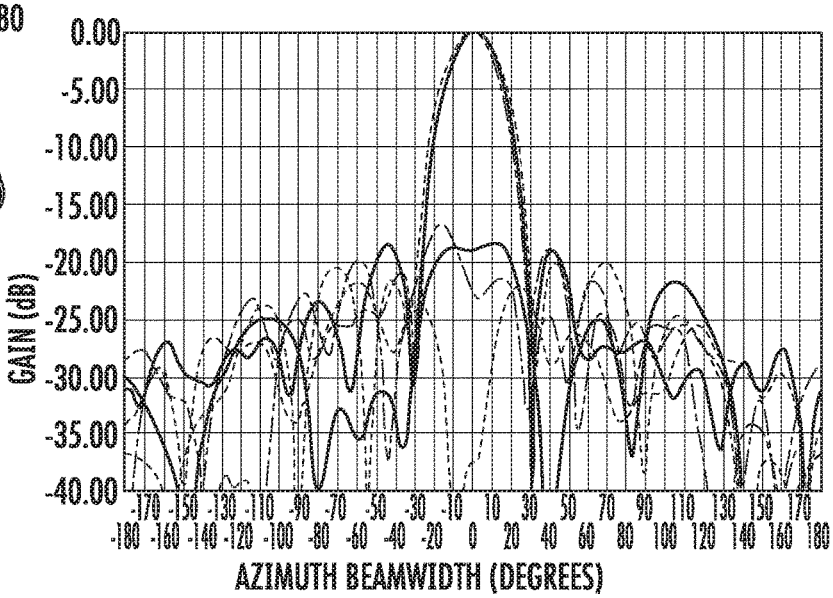
FIG. 6B is a graph illustrating the azimuth pattern of the center linear array of the antenna of FIG. 6A according to some embodiments of the inventive concept.

FIG. 6A illustrates an RF lens 330 that includes six mid-sized (2 inch outer diameter, 1.5 inch inner diameter) heat dissipation pipes 280, five of which are arranged to define a pentagon (when viewed in cross-section) and with the sixth heat dissipation pipe located at the center of the pentagon. The RF lens 330 may be identical to the RF lens 250 included in base station antenna 200 of FIGS. 2A-2F. FIG. 6B illustrates the azimuth pattern for linear array 130-2 of base station antenna 200 when used with the RF lens 330. As can be seen by comparing FIGS. 3B and 6B, the main lobe FIG. 6B is slightly broadened as compared to the main lobe shown in FIG. 3B, but not so much as to be unacceptable for a nine-sector base station. The near side lobe levels are slightly degraded from the baseline sidelobe levels shown in FIG. 3B, but the far sidelobe levels are slightly improved as compared to the baseline sidelobe levels shown in FIG. 3B. Thus, the RF lens 330 has fairly good performance characteristics, and the inclusion of six heat dissipation pipes 280 that are spaced apart throughout the interior of the RF lens 330 should provide good heat removal performance. Moreover, the layout of the heat dissipation pipes 280 in RF lens 330 is relatively symmetrical with respect to the three linear arrays 130, and hence similar RF performance will be expected for all three linear arrays 130.

Figure 7:
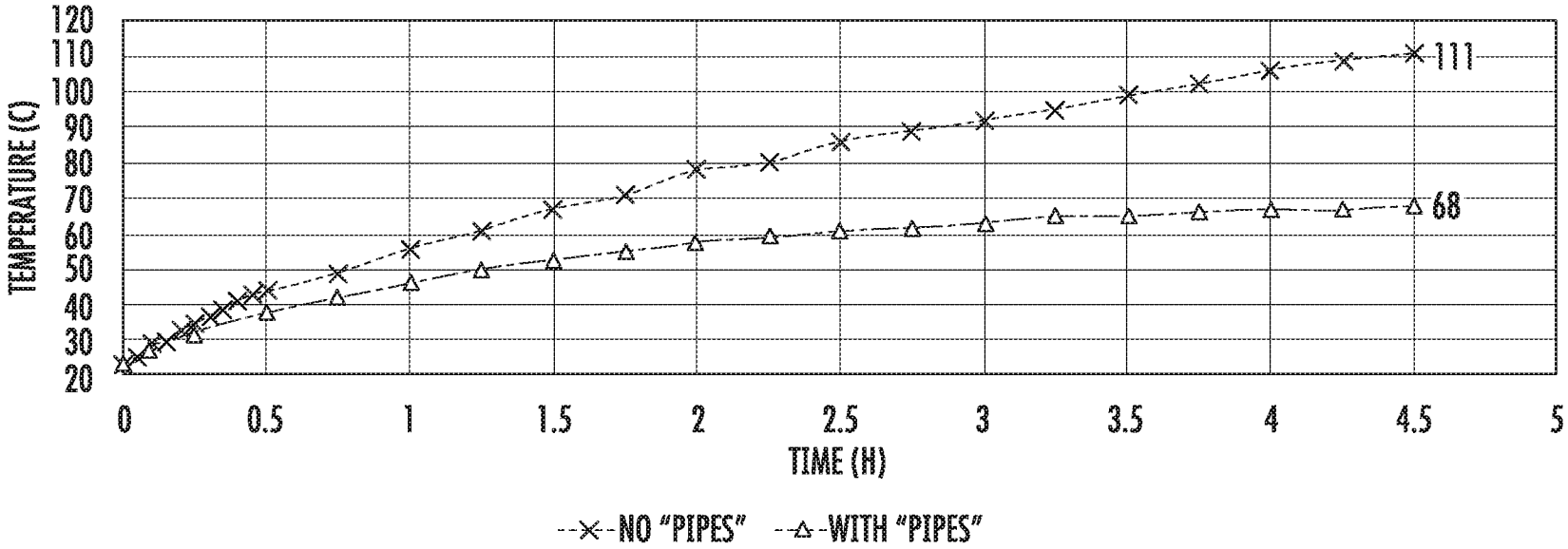
FIG. 7 is a graph illustrating the temperature of the RF energy focusing material that is included in the RF lens of the antenna of FIGS. 1A-1F as compared to the antenna of FIGS. 2A-2F according to some embodiments of the inventive concept.

FIG. 7 is a graph illustrating the measured temperature of the RF energy focusing material of the antenna of FIGS. 1A-1F as compared to the antenna of FIGS. 2A-2F when the two antennas were subjected to a high power test. Under the high power test conditions, all six of the RF ports 122 of each antenna were set at 50 Watts and the antennas 100, 200 were operated under these conditions for 4.5 hours. As shown in FIG. 7, under high power operating conditions, heat builds up within each RF lens 150, 250. The amount of heat build-up, however, is starkly different, with the RF energy focusing material in RF lens 150 heating up to 111° C. after 4.5 hours, while the RF energy focusing material in RF lens 250 only heats up to 68° C. during the same time period. Moreover, the heat build-up in RF lens 150 is still steadily increasing at the 4.5 hour point. For example, from 3 hours to 3.5 hours the temperature increases about 8° C., from 3.5 hours to 4 hours the temperature increases about 7° C. and from 3.5 hours to 4 hours the temperature increases about 5° C. In contrast, the heat build-up in RF lens 250 starts to plateau after about 3 or 3.5 hours. In particular, from 3 hours to 3.5 hours the temperature increases about 3° C., from 3.5 hours to 4 hours the temperature increases about 2° C. and from 4.0 hours to 4.5 hours the temperature only increases about 1° C. These results suggest that the base station antenna 200 may be operated for extended periods of time without subjecting the RF energy focusing material to high temperatures (e.g., temperatures of 90-100° C.).

Figure 8A:
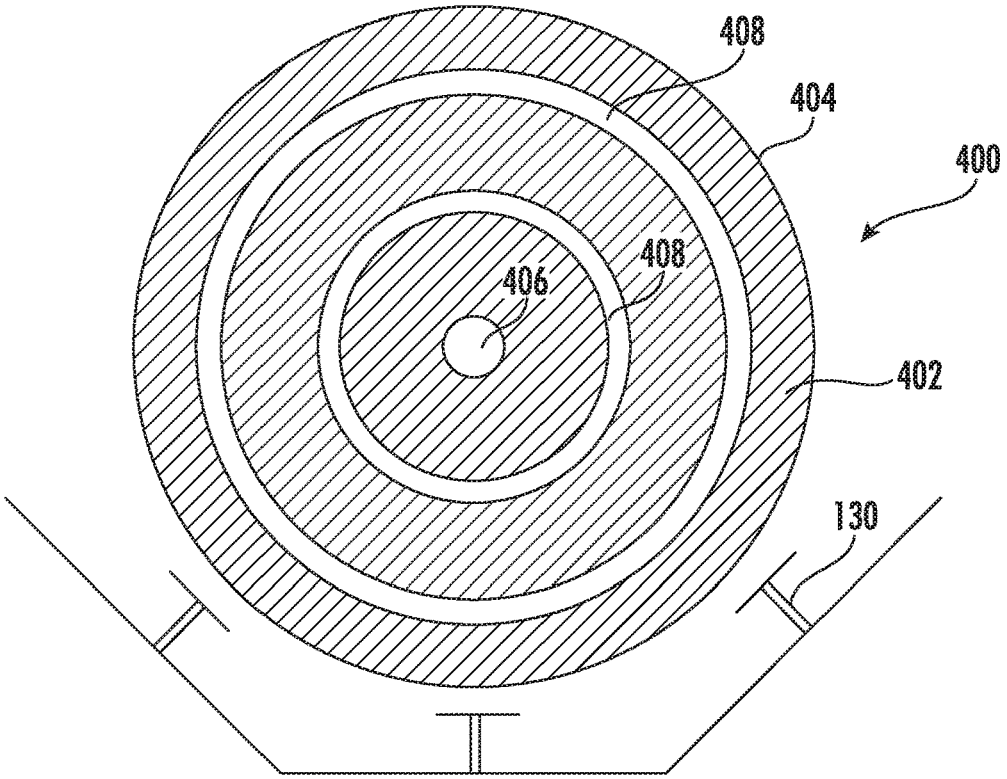
FIGS. 8A and 8B are schematic cross-sectional views of lensed base station antennas according to some embodiments of the inventive concept.
Figure 8B:
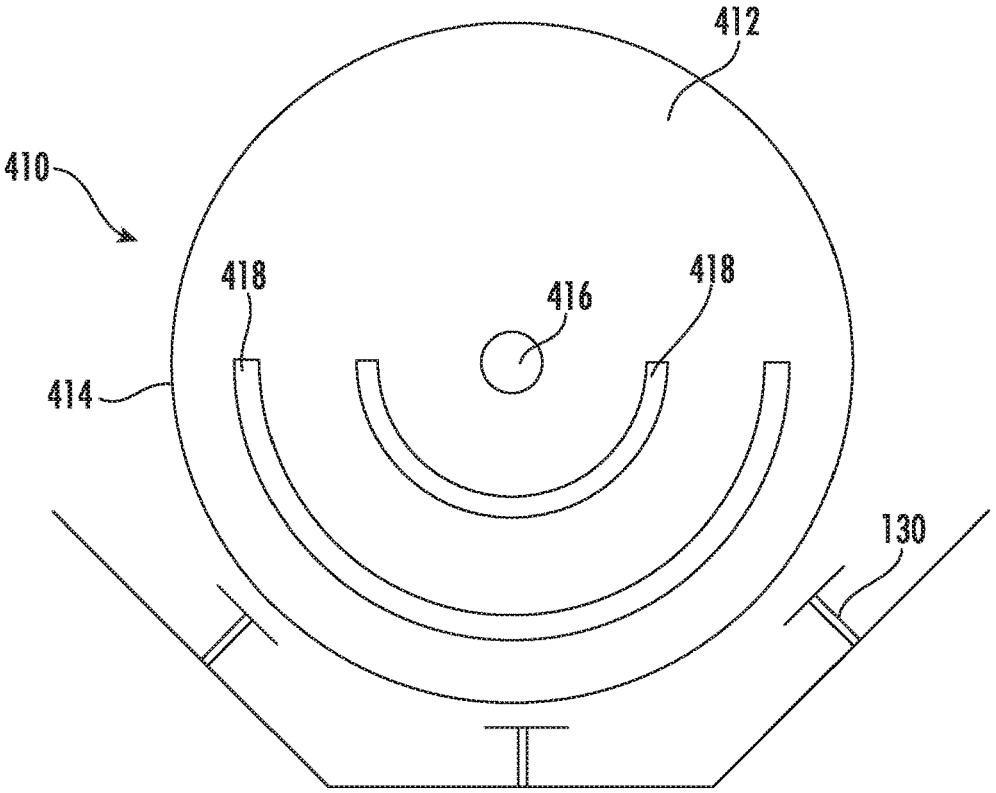

While in base station antenna 200 the heat dissipation channels 280 are implemented as heat dissipation pipes 280 that extend vertically through the RF lens 250, it will be appreciated that embodiments of the present inventive concept are not limited thereto. For example, FIGS. 8A and 8B are schematic transverse cross-sectional views that illustrate two additional RF lenses 400 and 410 that may be used in place of RF lens 250. As shown in FIG. 8A, the RF lens 400 includes an outer shell 404 that is filled with RF energy focusing material 402. The RF lens 400 further includes a plurality of heat dissipation channels 406, 408. A first of the heat dissipation channels 406 is implemented as a heat dissipation pipe 406 that extends vertically along the longitudinal axis of the RF lens 400. The other heat dissipation channels 408 are not implemented as heat dissipation pipes, but instead be are implemented as annular channels 408 that extend vertically through the RF lens 400. The use of annular channels may allow for a very symmetric arrangement of the heat dissipation channels 408 with respect to the linear arrays 130 so that the antenna beams generated by each linear array 130 "see" approximately the same amount of RF energy focusing material 402 when passing through the RF lens 400.

As shown in FIG. 8B, the RF lens 410 includes an outer shell 414 that is filled with RF energy focusing material 412. The RF lens 410 further includes a plurality of heat dissipation channels 416, 418. A first of the heat dissipation channels 416 is implemented as a heat dissipation pipe 416 that extends vertically along the longitudinal axis of the RF lens 410. The other heat dissipation channels 418 are implemented as semi-annular channels 418 that extend vertically through the RF lens 410. As discussed above, the heat build-up within an RF lens will primarily occur in two locations, namely in the regions close to the linear arrays and in the center of the RF lens (along the longitudinal axis of the RF lens) since the peak of each antenna beam passes through the center of the RF lens. The heat dissipation channels 416, 418 included in RF lens 410 are arranged to extend through the regions of the RF lens 410 where heat build-up will be the greatest. This may reduce the impact that inclusion of the heat dissipation channels 416,418 has on the RF energy focusing capabilities of the RF lens 410 while still providing good heat venting capability. Additionally, the heat dissipation channels 416, 418 included in RF lens 410 may again be very symmetric with respect to the linear arrays 130 so that the antenna beams generated by each linear array 130 "see" approximately the same amount of RF energy focusing material 414 when passing through the RF lens 410.

Figure 9A:
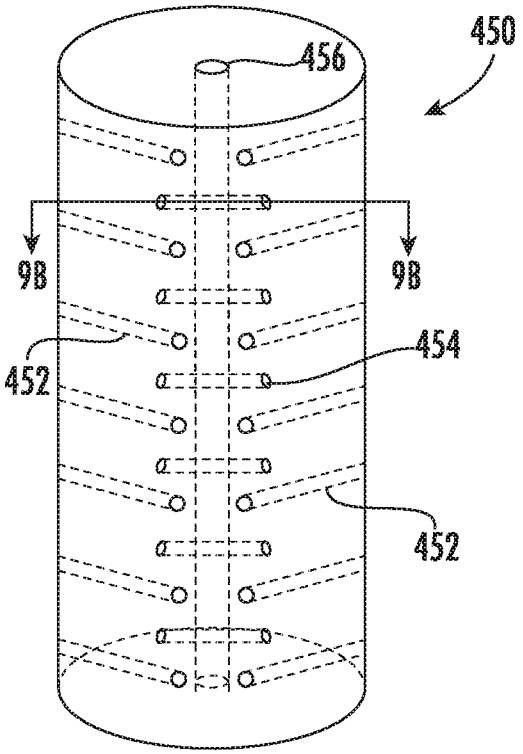
FIG. 9A is a schematic perspective view of an RF lens according to further embodiments of the present inventive concept that includes horizontal heat dissipation channels.
Figure 9B:
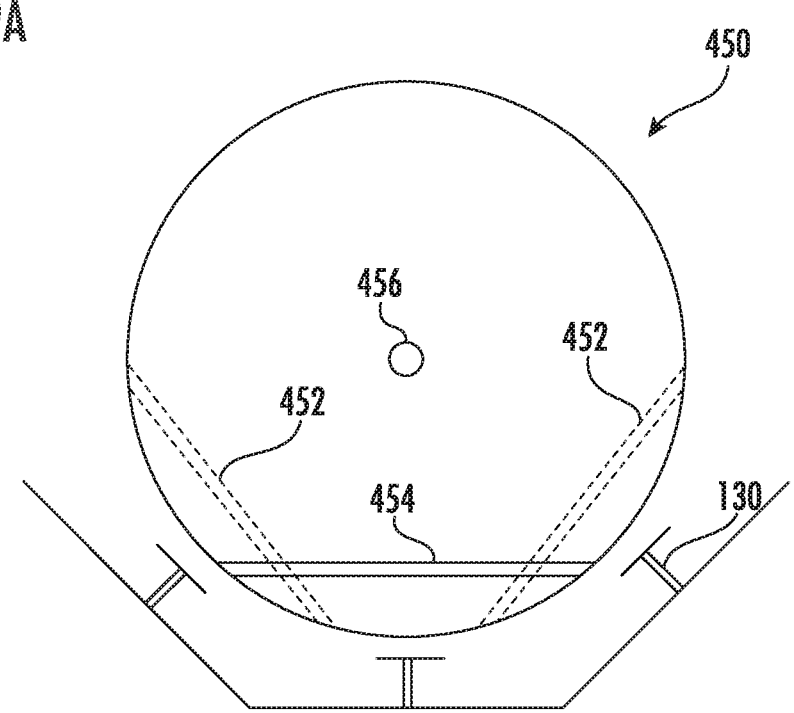
FIG. 9B is a schematic transverse cross-sectional view of a base station antenna that includes the RF lens of FIG. 9A according to some embodiments of the inventive concept.

While the above-described RF lenses according to embodiments of the present inventive concept include vertically-extending heat dissipation channels, it will be appreciated that the present inventive concept is not limited thereto. For example, FIGS. 9A and 9B illustrate an RF lens 450 that includes a plurality of horizontally-extending heat dissipation pipes 452, 454 as well as a vertically-extending heat dissipation pipe 456 that extends along the longitudinal axis of the RF lens 450.

It will also be appreciated that the heat dissipation channels need not always extend the full way through the RF lens. For example, as discussed above with respect to FIG. 2G, in some embodiments the heat dissipation channels may terminate near the top of the RF lens such that they do not extend through the top of the RF lens.

It will be appreciated that the heat dissipation channels need not be air-filled channels in some embodiments. For example, in other embodiments, the heat dissipation channels may contain a thermally conductive material therein that may facilitate removal of heat from the RF energy focusing material in the RF lens. The thermally conductive material, however, should allow RF energy to pass therethrough.

It will also be appreciated that more than one RF lens may be included in the base station antennas according to embodiments of the present inventive concept. For example, the circular cylindrical RF lens 250 of base station antenna 200 could be replaced with a stack of multiple circular cylindrical RF lenses that may be identical to RF lens 250 except that each RF lens may have a shorter height. These shorter RF lenses could be stacked to provide a multi-piece RF lens having the exact same shape as RF lens 250.

Alternatively, small gaps could be provided between the stacked lens to further facilitate air flow through the heat dissipation pipes.

Figure 10A:
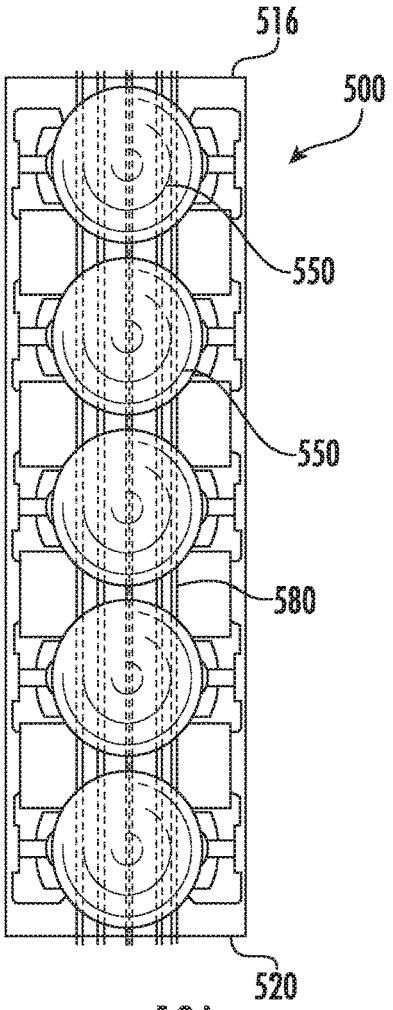
FIG. 10A is a schematic front view of lensed base station antenna according to some embodiments of the inventive concept that includes an array of spherical RF lenses.
Figure 10B:
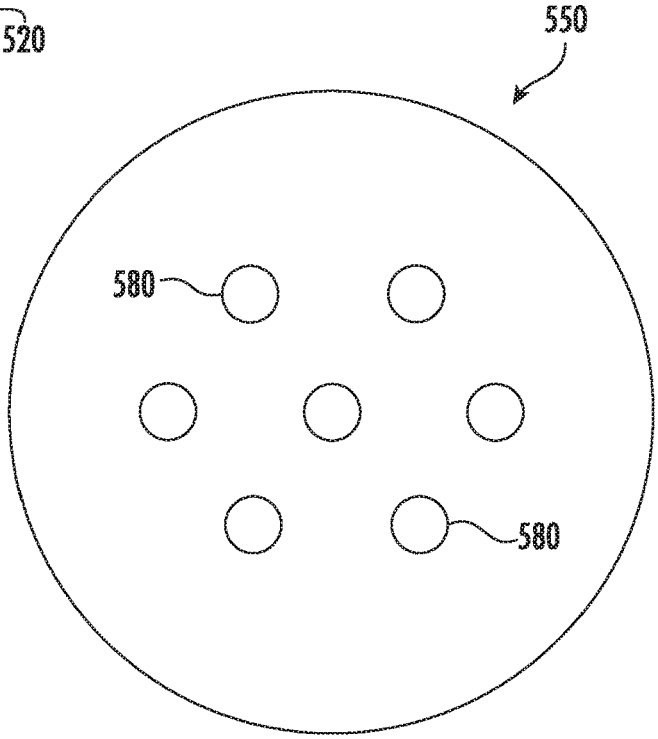
FIG. 10B is a schematic top view of one of the RF lenses included in the antenna of FIG. 10A according to some embodiments of the inventive concept.

As another example, a plurality of spherical RF lenses or elliptical RF lenses could be used in place of the RF lens 250. For example, FIG. 10A is a schematic front view of a base station antenna 500 in which the RF lens 250 is replaced with five spherical RF lenses 550. Two of the radiating elements 132 of each linear array 130 may be mounted behind each spherical RF lens 550. FIG. 10B is a top view of one of the spherical RF lenses 550. As shown in FIG. 10B, a plurality of heat dissipation pipes 580 extend vertically through each spherical RF lens 550. Referring again to FIG. 10A, it can be seen that each heat dissipation pipe 580 extends through all five spherical RF lenses 550 and through the top end cap 516 and the bottom end cap 520 of the antenna 500. Thus, it will be appreciated that the heat dissipation channels disclosed herein may be used in any shaped RF lens.

Figure 11A:
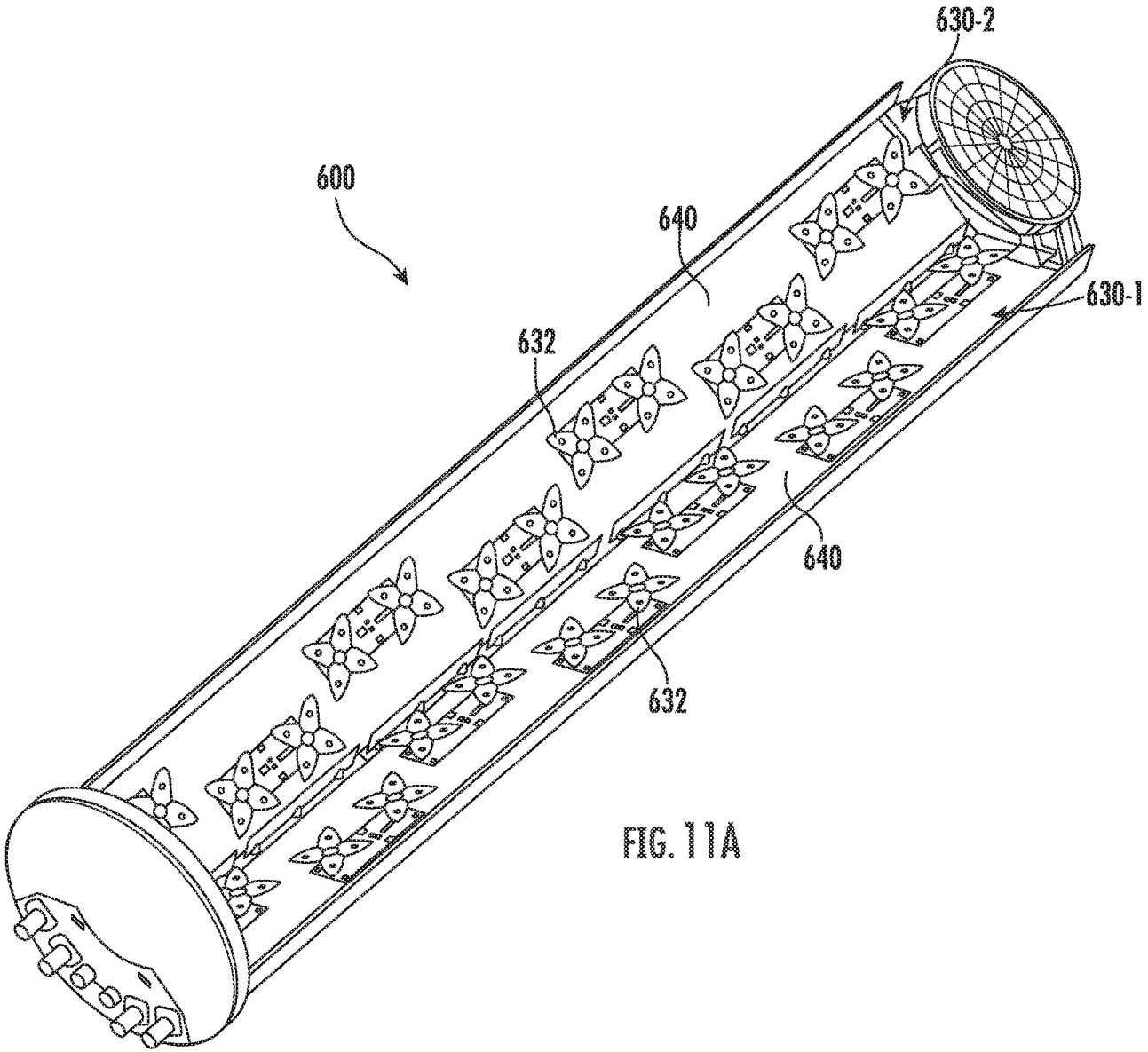
FIG. 11A is a schematic perspective view of a dual-beam base station antenna that may be used with an RF lens having heat dissipation elements according to some embodiments of the inventive concept.

It will likewise be appreciated that the non-lens portions of the base station antennas according to embodiments of the present inventive concept may have any appropriate design, including different numbers of linear arrays, different array designs, different types of radiating elements, etc. As one simple example, FIG. 11A illustrates a base station antenna 600 that includes two staggered vertical arrays 630 of radiating elements 632 that may be used in conjunction with any of the RF lenses according to embodiments of the present inventive concept. As shown in FIG. 11A, the base station antenna 600 has two reflectors 640 and two vertical arrays 630 of radiating elements 632 as compared to base station antenna 200, which includes three reflectors 140 and three linear arrays 130. Thus, base station antenna 600 may be suitable, for example, for use with a six-sector base station, while base station antenna 200 may be more appropriate for use with a nine-sector base station. Moreover, the base station antenna 600 includes so-called "staggered" linear arrays 630 in which the radiating elements 632 in an array are not all aligned along a common vertical axis, but instead some of the radiating elements 632 in a vertical array 630 are offset from other of the radiating elements 632 in the array 630 by a small amount. In the particular example illustrated in FIG. 11A, all of the radiating elements 632 in a given array 630 are aligned along one of two vertical axes. As explained in U.S. Provisional Patent Application Ser. No. 62/722,238, filed Aug. 24, 2018, such staggered vertical arrays may be included in base station antennas in order to improve the stability of the azimuth beamwidth across the frequency band of operation.

Figure 11B:
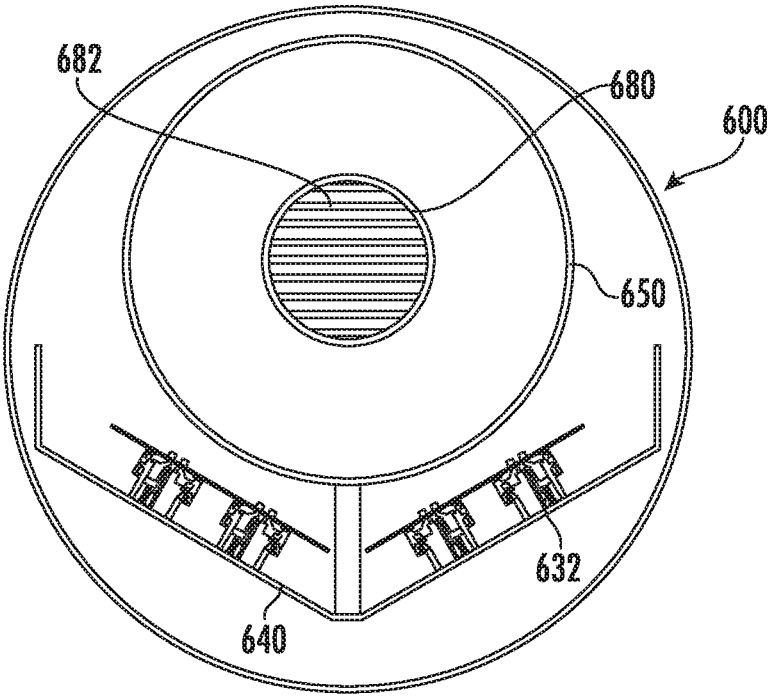
FIG. 11B is a schematic cross-sectional view of the dual-beam antenna of FIG. 11A with an RF lens in place that includes a first heat dissipation element design according to some embodiments of the inventive concept.
Figure 11C:
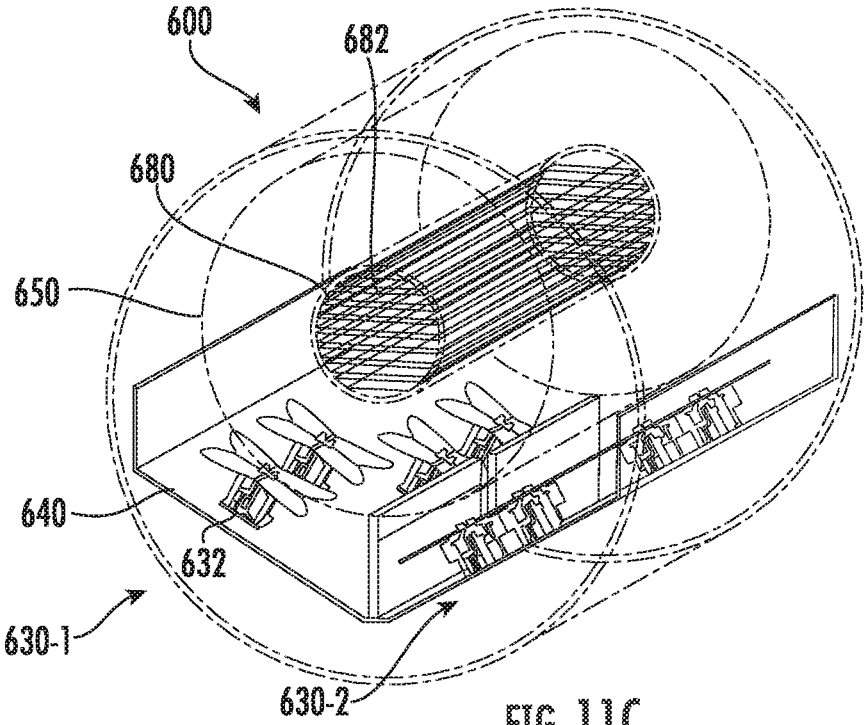
FIG. 11C is a schematic perspective view of a portion of the antenna of FIG. 11B according to some embodiments of the inventive concept.

FIG. 11B is a schematic cross-sectional view of the dual-beam antenna 600 of FIG. 11A with an RF lens in place that includes a first heat dissipation element design, and FIG. 11C is a schematic perspective view of a portion of the antenna 600.

As shown in FIGS. 11B-11C, the antenna 600 may include a circular cylindrical RF lens 650 that is positioned in front of the two staggered linear arrays 630-1, 630-2 of radiating elements 632. The RF lens 650 includes a single heat dissipation element 680 in the form of a large heat dissipation pipe 680 that extends along the longitudinal axis of the RF lens 650. The heat dissipation pipe 680 may have, for example, an outer diameter of 4.5 inches and an inner diameter of 4.0 inches. The heat dissipation pipe 680 may be formed of polyvinyl chloride having a dielectric constant of, for example, about 3.2.

As can be seen in FIGS. 11B and 11C, the heat dissipation pipe 680 includes a grating 682 in the interior thereof, which may be designed to both provide structural support and to shape the antenna pattern in the azimuth plane. In the embodiment of FIGS. 11B-11C, the grating 682 comprises a plurality of stripes of PVC material that extend through the interior of the heat dissipation pipe 680.

Figure 11D:
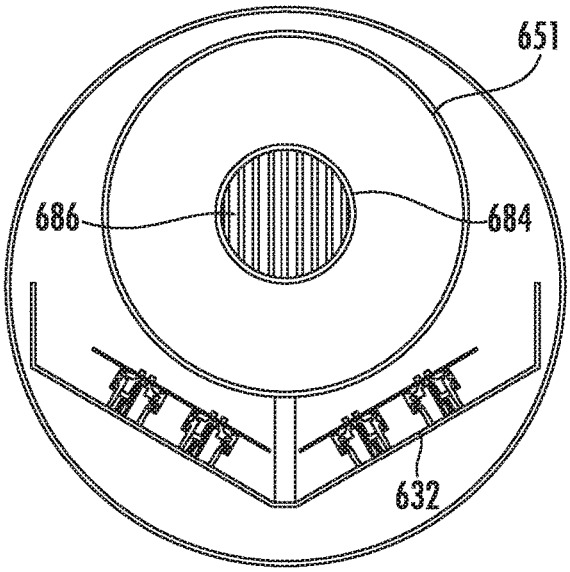
FIGS. 11D-11F are schematic cross-sectional views of the dual-beam antenna of FIG. 11A with RF lens having several additional heat dissipation element designs according to some embodiments of the inventive concept.
Figure 11E:
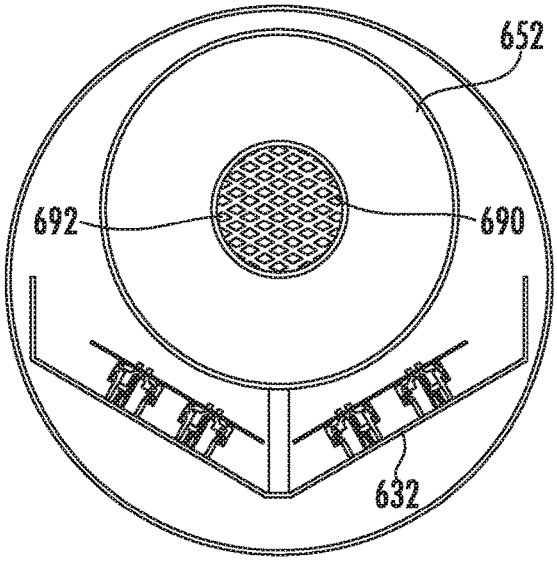
Figure 11F:
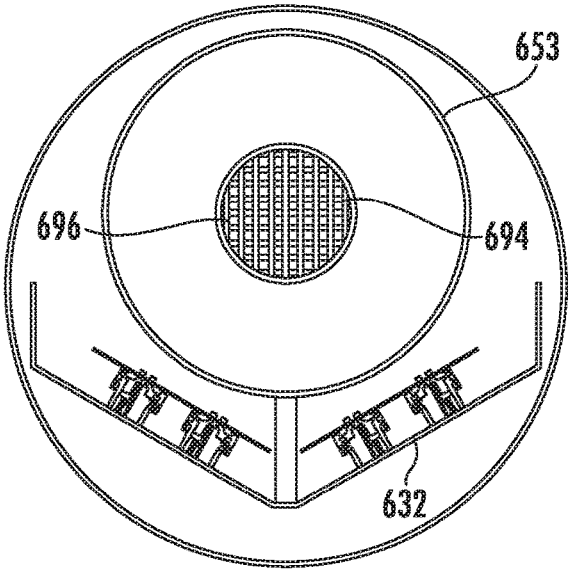

While FIGS. 11B and 11C illustrate one possible grating design, it will be appreciated that embodiments of the present inventive concept are not limited thereto. For example, FIGS. 11D-11F are schematic cross-sectional views of the dual-beam antenna of FIG. 11A with RF lens having heat dissipation elements 684, 690, 694 having several different grating designs. In particular, FIG. 11D shows an RF lens 651 that may be identical to RF lens 650 except that the heat dissipation pipe 684 included in RF lens 651 includes grating stripes 686 that are rotated 90° from the grating stripes 682 included in RF lens 650. FIG. 11E shows an RF lens 652 that is similar to RF lens 650 except that the heat dissipation pipe 690 included in RF lens 652 includes a grating 692 that defines a plurality of longitudinally-extending channels that have generally triangular transverse cross-sections. FIG. 11F shows an RF lens 653 that is similar to RF lens 652 except that the heat dissipation pipe 694 included in RF lens 653 includes a grating 694 that defines a plurality of longitudinally-extending channels that have generally rectangular transverse cross-sections.

Figure 11G:
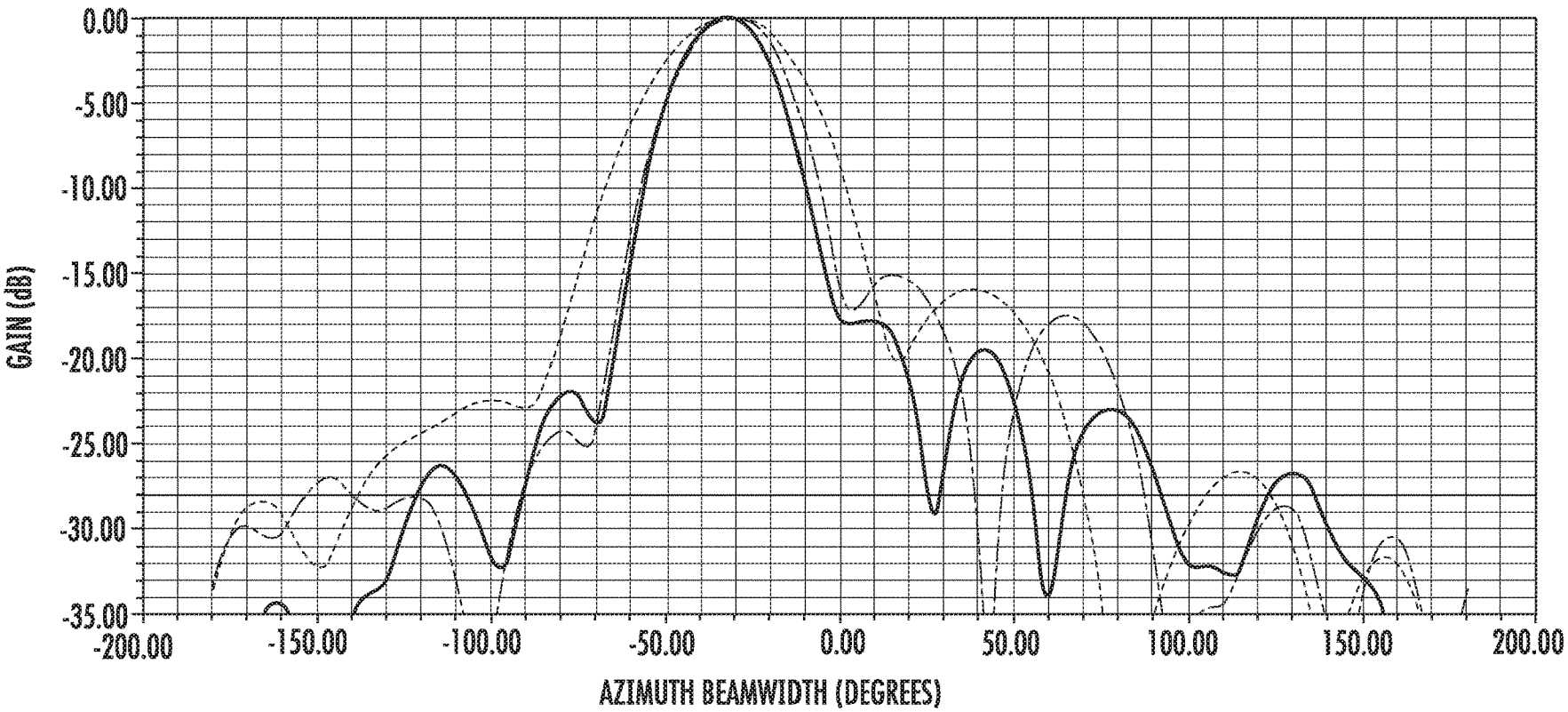
FIG. 11G is a graph illustrating the azimuth pattern of one of the linear arrays of the antenna of FIG. 11A when used with a conventional circular cylindrical RF lens that does not include any heat dissipation elements.
Figure 11H:
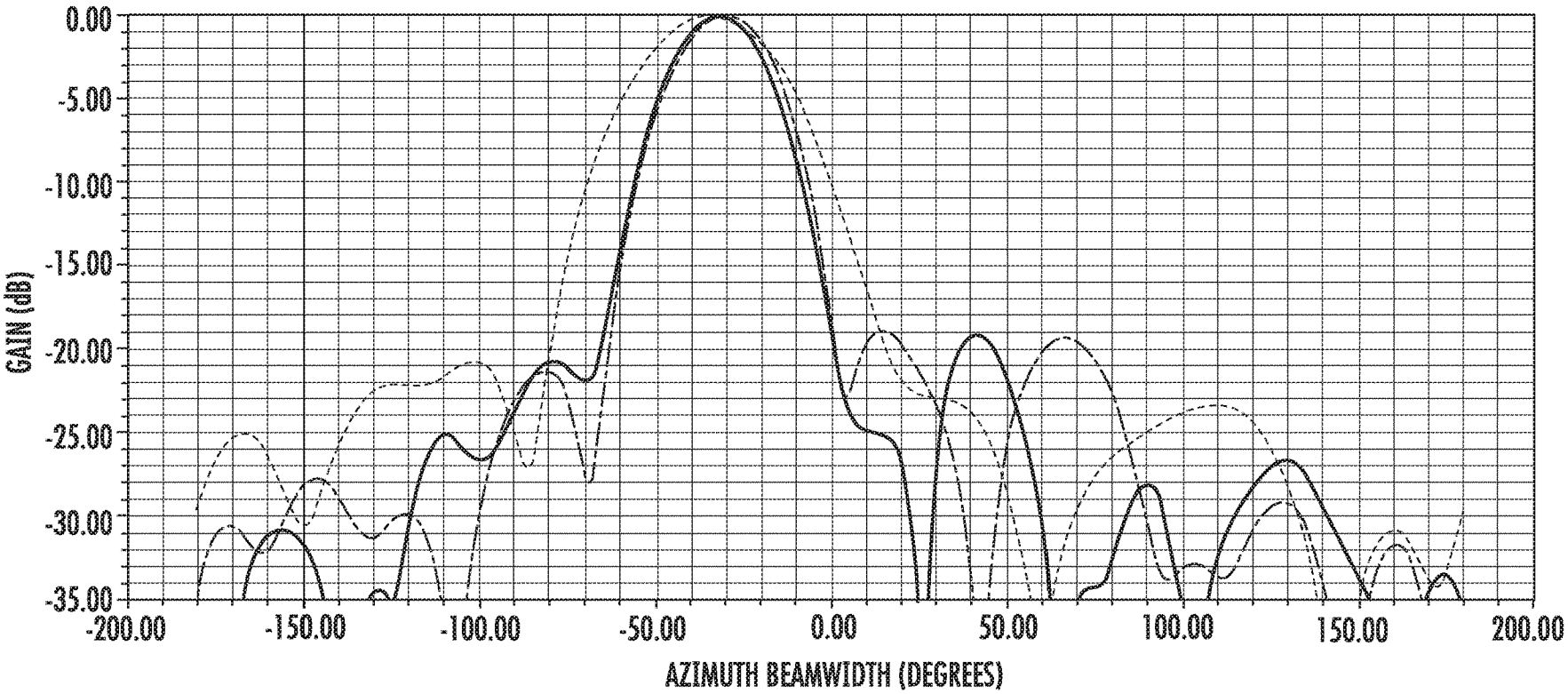
FIG. 11H is a graph illustrating the azimuth pattern of one of the linear arrays of the antenna of FIGS. 11B-C according to some embodiments of the inventive concept.

FIG. 11G is a graph illustrating the azimuth pattern of one of the linear arrays of the antenna of FIG. 11A when used with a conventional circular cylindrical RF lens that does not include any heat dissipation elements, while FIG. 11H is a graph illustrating the azimuth pattern of one of the linear arrays of the antenna of FIGS. 11B-C. As can be seen, FIG. 11H shows that an additional 3-4 dB improvement (reduction) is obtained in the sidelobe levels as compared to FIG. 11G.

Figure 12:
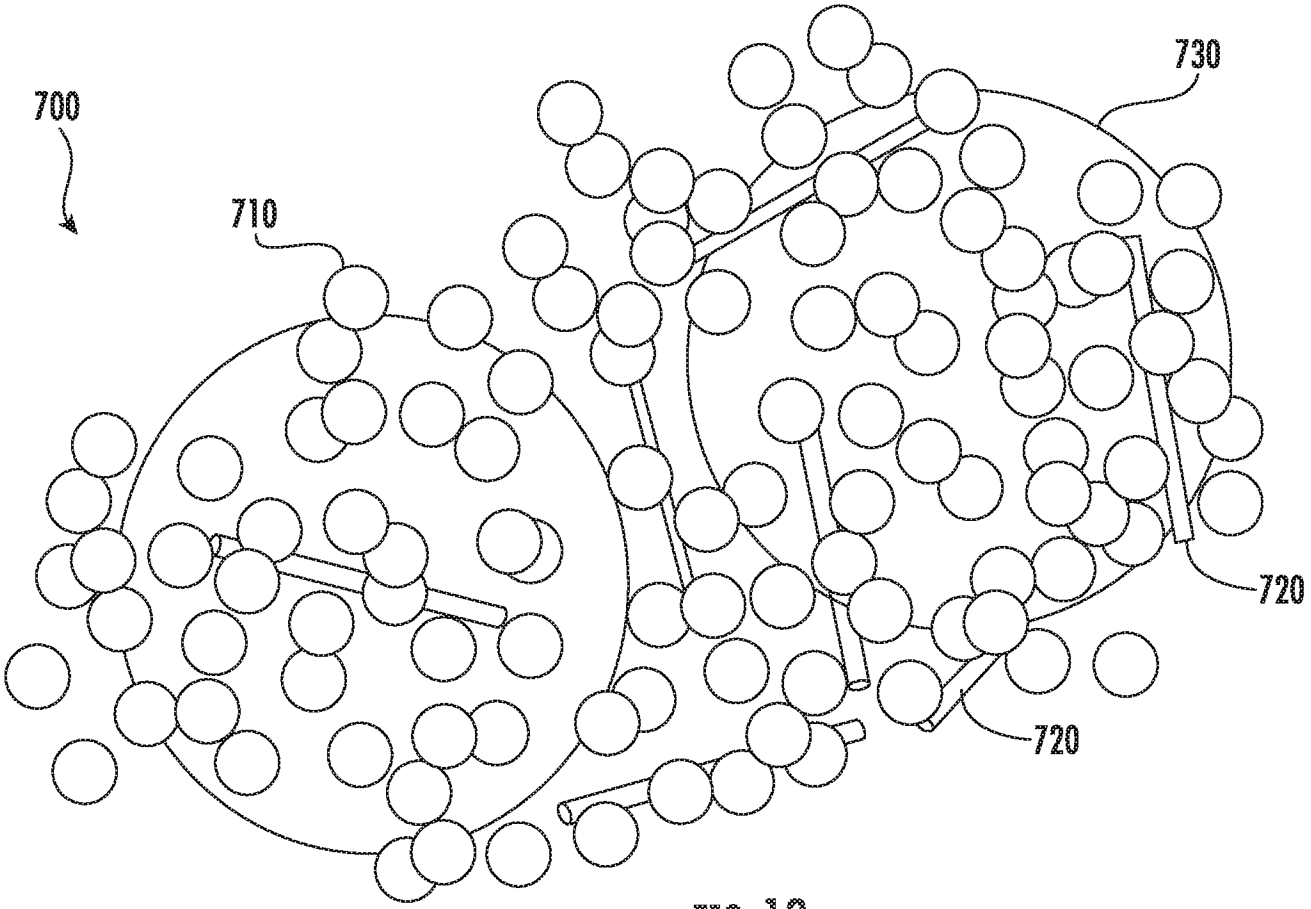
FIG. 12 is a schematic perspective view of an example composite dielectric material that may be used as the RF energy focusing material in the RF lenses according to some embodiments of the inventive concept.

FIG. 12 is a schematic perspective view of a composite dielectric material 700 that is one example of a composite dielectric material that may be used as the RF energy focusing material in the RF lenses according to embodiments of the present inventive concept. The composite dielectric material 700 includes expandable microspheres 710 (or other shaped expandable materials), conductive materials 720 (e.g., conductive sheet material) that have an insulating material on each major surface, dielectric structuring materials 730 such as foamed polystyrene microspheres or other shaped foamed particles, and a binder 740 (not shown) such as, for example, an inert oil.

The expandable microspheres 710 may comprise very small (e.g., 1-10 microns in diameter) spheres that expand in response to a catalyst (e.g., heat) to larger (e.g., 12-100 micron in diameter) air-filled spheres. These expanded microspheres 710 may have very small wall thickness and hence may be very lightweight. The small pieces of conductive sheet material 720 having an insulating material on each major surface may comprise, for example, flitter (i.e., small flakes of thin sheet metal that has a thin insulative coating on both sides thereof). The dielectric structuring materials 730 may comprise, for example, equiaxed particles of foamed polystyrene or other lightweight dielectric materials such as expanded polypropylene. The dielectric structuring materials 730 may be larger than the expanded microspheres 710 in some embodiments. The dielectric structuring materials 730 may be used to control the distribution of the conductive sheet material 720 so that the conductive sheet material has, for example, a suitably random orientation in some embodiments.

The microspheres 710, flitter flakes 720, dielectric structuring materials 730 and binder 740 may be mixed together and heated to expand the microspheres 710. The resulting mixture may comprise a lightweight, flowable paste that may be pumped or poured into a shell to form an RF lens. The expanded microspheres 710 along with the binder 740 may form a matrix that holds the flitter flakes 720 and dielectric structuring materials 730 in place to form the composite dielectric material 700. The binder 740 may generally fill the open areas between the expanded microspheres 710, the flitter flakes 720 and the dielectric structuring materials 730 and hence is not shown separately in FIG. 12 for ease of illustration.

While FIG. 12 illustrates one RF energy focusing material that may be used in the RF lenses according to embodiments of the present inventive concept, it will be appreciated that this material is just one example of a suitable material. U.S. Patent Publication No. 2018/0166789, filed Jan. 29, 2018, the entire content of which is incorporated herein by reference, describes a wide variety of other suitable composite dielectric materials which may alternatively be used. Conventional lightweight dielectric materials may also be used such as, for example, foamed polystyrene or expanded polypropylene.

Figure 13A:
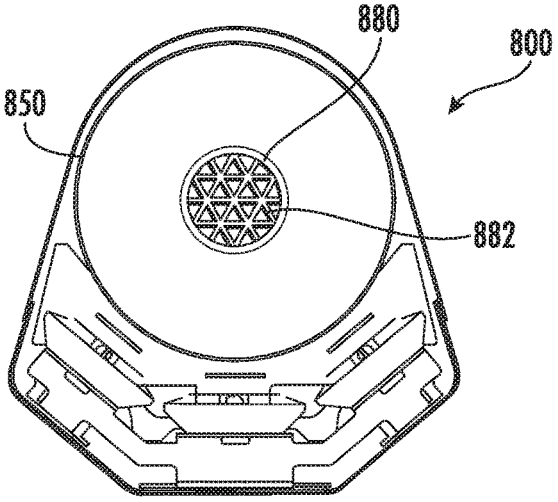
FIG. 13A is a cross-sectional view of a lensed base station antenna according to some embodiments of the inventive concept.
Figure 13B:
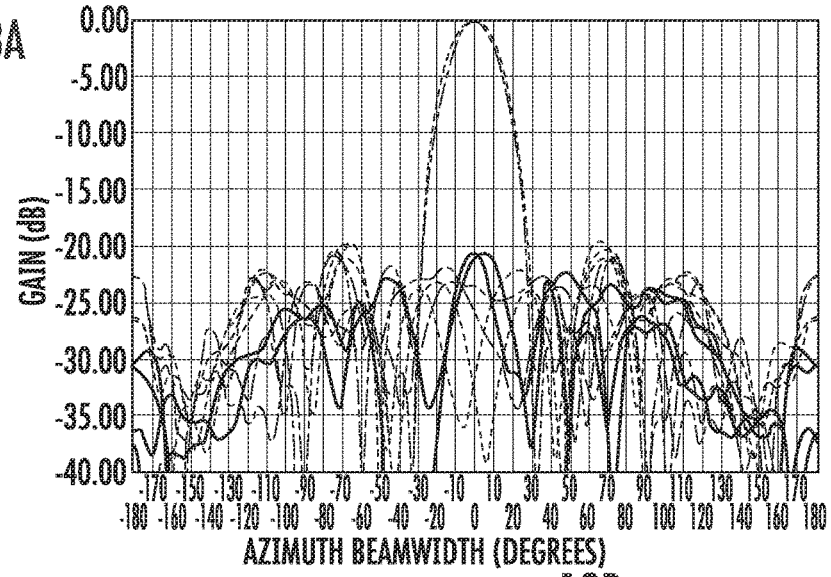
FIGS. 13B and 13C are graphs illustrating the azimuth pattern of the center linear array and all three of the linear arrays, respectively, of the antenna of FIG. 13A according to some embodiments of the inventive concept.
Figure 13C:
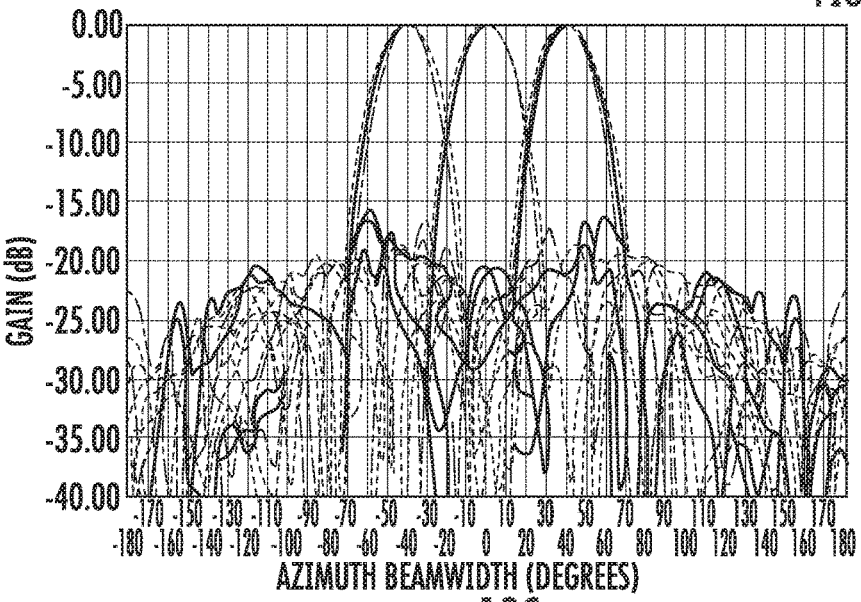

FIG. 13A is a cross-sectional view of a lensed base station antenna 800 according to further embodiments of the present inventive concept. FIGS. 13B and 13C are graphs illustrating the azimuth pattern of the center linear array and all three of the linear arrays, respectively, of the lensed base station antenna 800 of FIG. 13A.

As shown in FIG. 13A, the lensed base station antenna 800 includes an RF lens 850 that has a heat dissipation element 880 extending vertically therethrough. The heat dissipation element 880 takes the form of a relatively large (4 inch outer diameter, 3.5 inch inner diameter) polyvinyl chloride (dielectric constant of about 3.2) heat dissipation pipe 880 that includes a triangular grating 880 in the interior of the pipe 880. The grating 882 may have the transverse cross-section shown in FIG. 13A for its full length. As shown in FIGS. 13B and 13C, good azimuth patterns are provided for all three antenna beams (and particularly for the central antenna beam).

Figure 14A:
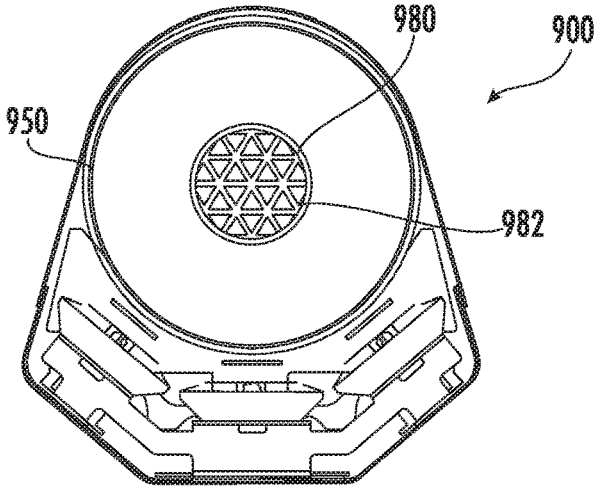
FIG. 14A is a cross-sectional view of a lensed base station antenna according to some embodiments of the inventive concept.
Figure 14B:
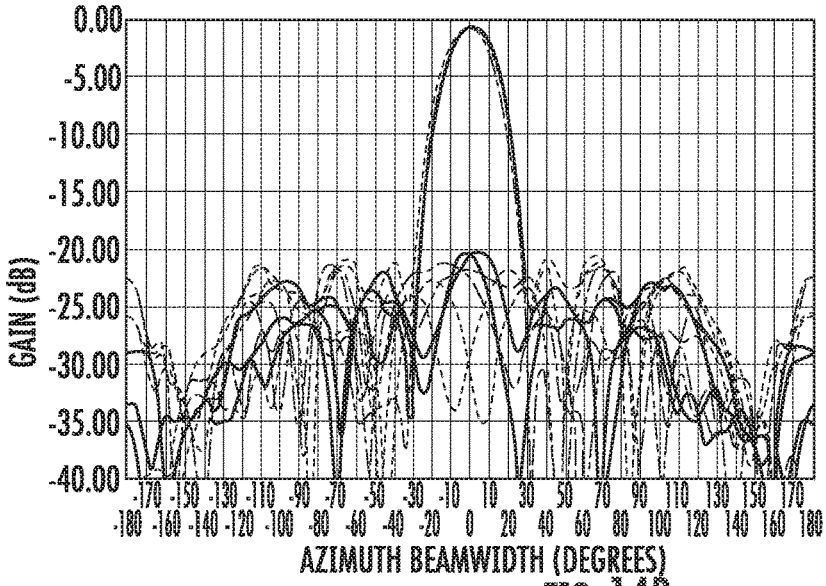
FIGS. 14B and 14C are graphs illustrating the azimuth pattern of the center linear array and all three of the linear arrays, respectively, of the antenna of FIG. 14A according to some embodiments of the inventive concept.
Figure 14C:
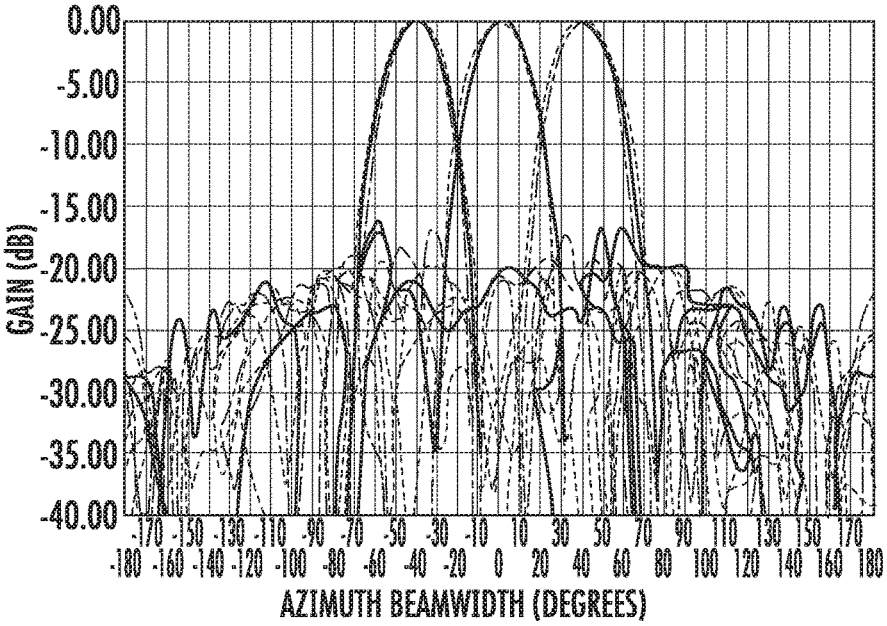

FIG. 14A is a cross-sectional view of a lensed base station antenna 900 according to further embodiments of the present inventive concept. FIGS. 148 and 14C are graphs illustrating the azimuth pattern of the center linear array and all three of the linear arrays, respectively, of the lensed base station antenna 900 of FIG. 14A.

As shown in FIG. 14A, the lensed base station antenna 900 includes an RF lens 950 that has a heat dissipation element 980 extending vertically therethrough. The heat dissipation element 980 takes the form of a slightly larger (4.5 inch outer diameter, 4 inch inner diameter) polyvinyl chloride (dielectric constant of about 3.2) heat dissipation pipe 980 that includes a triangular grating 980 in the interior of the pipe 980. The grating 982 may have the transverse cross-section shown in FIG. 14A for its full length. As shown in FIGS. 14B and 14C, good azimuth patterns are provided for all three antenna beams (and particularly for the central antenna beam).

Figure 15A:
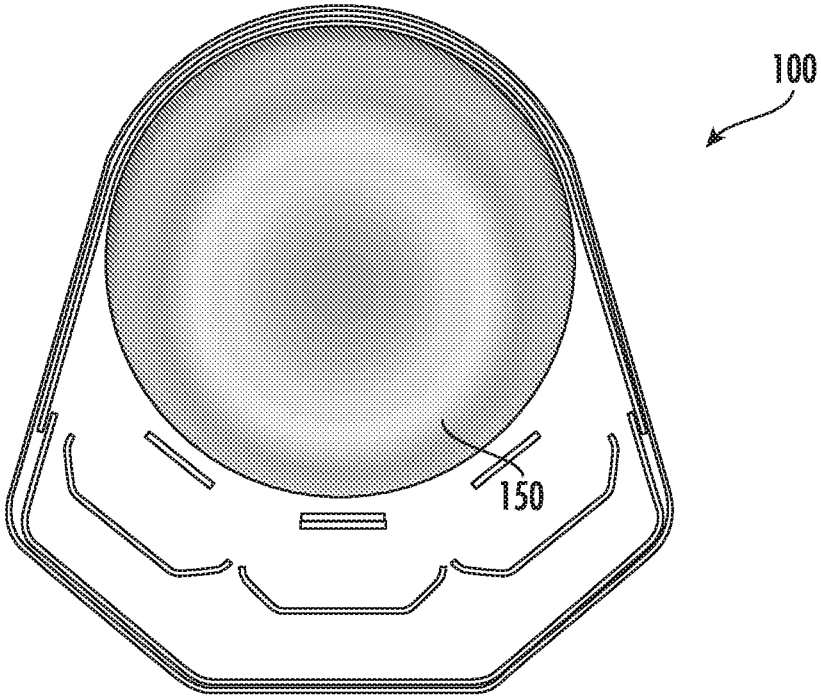
FIGS. 15A and 15B are thermal simulations illustrating the relative temperature of the RF energy focusing material in the RF lenses included in the base station antennas of FIGS. 1A-1F and FIGS. 2A-2F, respectively after the antennas have been operated for an extended period of time at peak power according to some embodiments of the inventive concept.
Figure 15B:
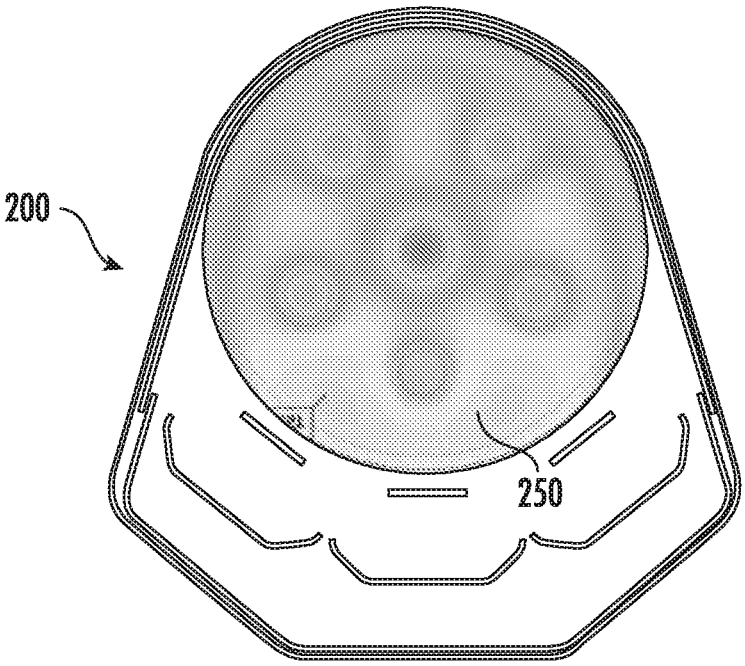

FIGS. 15A and 15B are thermal simulations illustrating the relative temperature of the RF energy focusing material in the RF lens 150 of base station antenna 100 and the RF lens 250 of base station antenna 200, respectively after the antennas 100, 200 have been operated for an extended period of time at peak power. As shown in FIG. 15A, in base station antenna 100 significant heat build-up may occur within RF lens 150, with the highest levels of heat build-up occurring in the center of the RF lens 150. The heat build-up is also higher along the portion of the RF lens 150 that is adjacent to the linear arrays of radiating elements. As shown in FIG. 15B, significantly less heat build-up is seen in the RF lens 250 that includes heat dissipation pipes as compared to the RF lens 150.

Pursuant to further embodiments of the inventive concept, base station antennas are provided that include RF lenses having heat dissipation elements that include a cooling fluid therein, which may be used to evacuate heat from the interior of the RF lens. In some embodiments, the heat dissipation elements may each include a cooling fluid filled chamber and an air or lattice filled chamber. A condenser may be coupled to the heat dissipation elements to facilitate circulation of the cooling fluid therebetween. In some embodiments, passive apparatus, such as a wind turbine and/or a rotatable vent, may be coupled to the heat dissipation elements to draw air through channels formed therein to improve the extraction of heat from the RF lens. As described above, the heat dissipation elements may be used to prevent or reduce the likelihood of damage to the RF energy focusing material within an RF lens and/or degradation in performance of the RF lens due to overheating. The cooling capabilities of the heat dissipation elements within the RF energy focusing material of an RF lens may allow base station antennas to transmit at higher power levels through the RF lens. The placement of the heat dissipation elements within the RF energy focusing material of a lens may be selected based on regions within the RF energy focusing material that are more likely to be hotter than other regions. These regions may include areas within the RF energy focusing material that intersect with radiation patterns generated by the antenna radiating elements.

Figure 16:
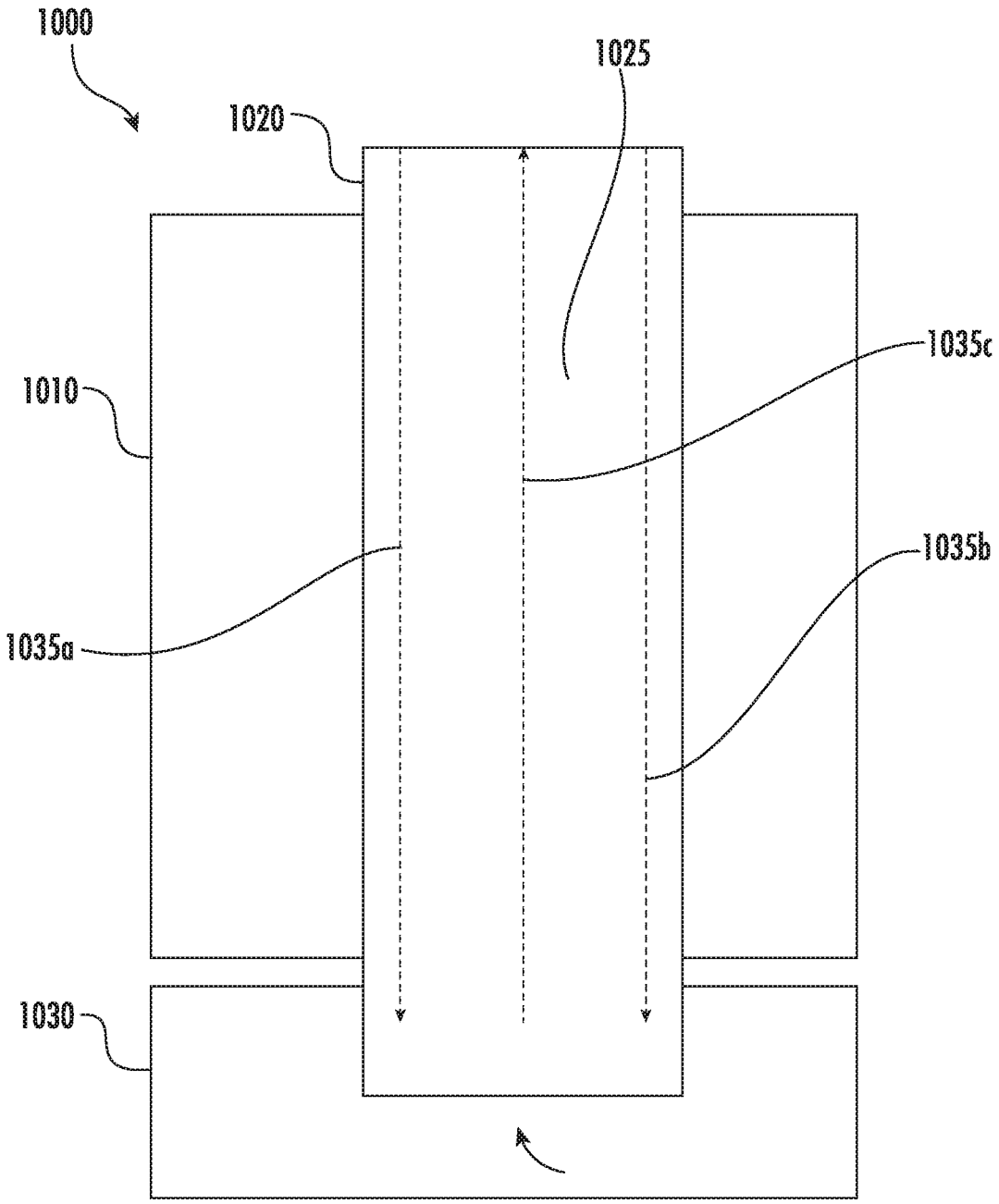
FIG. 16 is a cross-sectional view of an RF lens including a single heat dissipation element containing cooling fluid in accordance with some embodiments of the inventive concept.

Referring to FIG. 16, an RF lens 1000 assembly that can be used in a base station antenna, according to some embodiments of the inventive concept, comprises RF energy focusing material 1010 having a heat dissipation element 1020 that extends therethrough. The heat dissipation element 1020 may be a heat dissipation channel that contains a cooling fluid 1025. A condenser 1030 is coupled to the heat dissipation element 1020 to facilitate the extraction of heat from the RF energy focusing material 1010. As shown in FIG. 16, as the cooling fluid 1025 heats up, for example, due to the transmission of RF beams through the RF energy focusing material 1010, the cooling fluid 1025 may transition to a gas state, thereby absorbing thermal energy, and may migrate towards the condenser 1030 as represented by fluid flow paths 1035*a* and 1035*b*. Upon reaching the condenser 1030, the cooling fluid 1025 transitions from the gas state back into a liquid state thereby releasing thermal energy. The cooling fluid 1025 having transitioned back into the liquid state in the condenser 1030 migrates back into the heat dissipation element 1020 as represented by fluid flow path 1035*c* to once again absorb thermal energy from the RF energy focusing material 1010. In other embodiments, the cooling fluid 1025 does not transition between the liquid and gas states, but instead remains in a liquid state during the cooling process. Heated cooling fluid 1025 migrates towards the condenser 1030 where the fluid is cooled and then returned into the heat dissipation element 1020.

Figure 17:
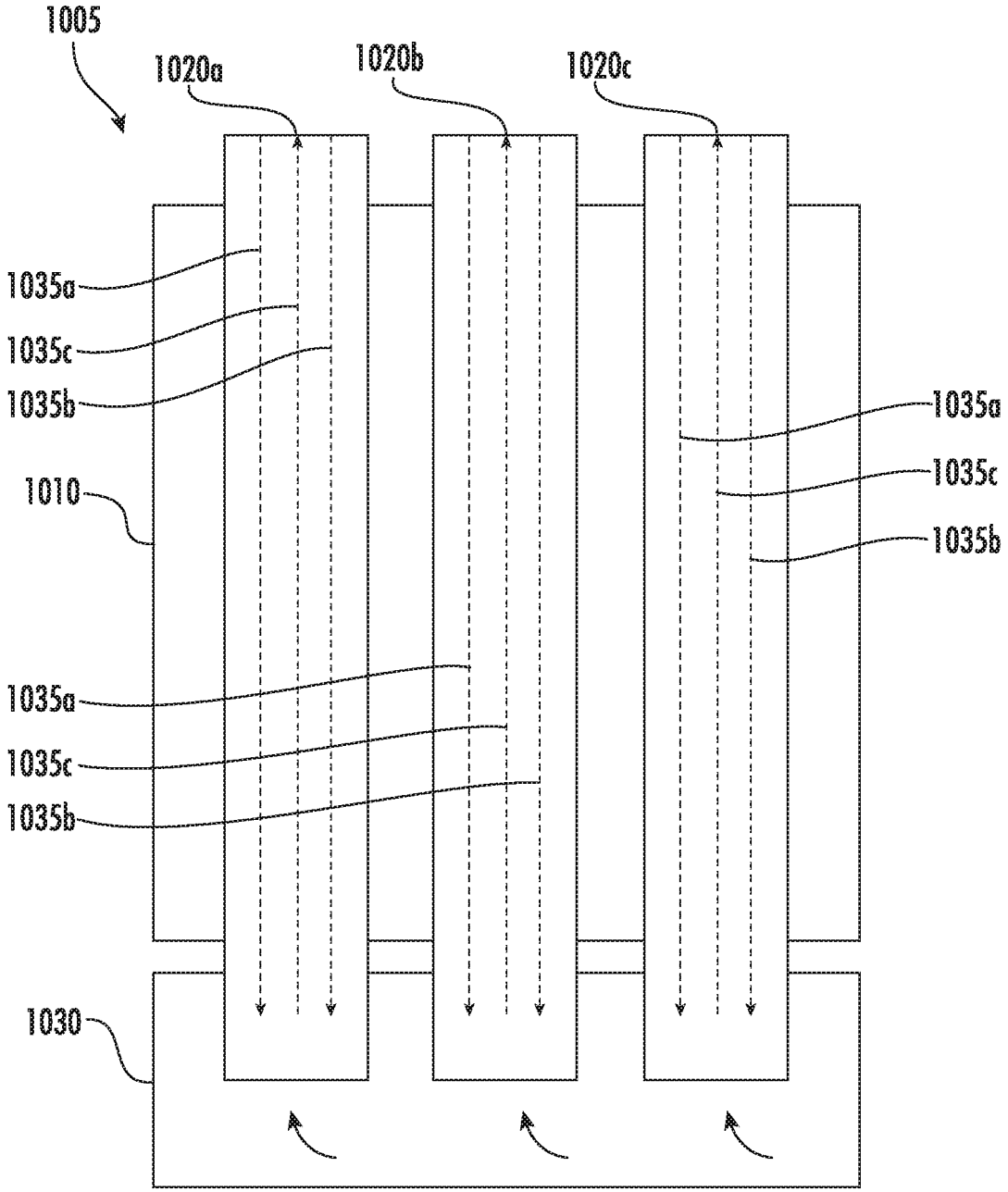
FIG. 17 is a cross-sectional view of an RF lens including multiple heat dissipation elements containing cooling fluid in accordance with some embodiments of the inventive concept.

Referring to FIG. 17, an RF lens 1005 assembly is depicted that can be used in a base station antenna according to some embodiments of the inventive concept. The RF lens 1005 is similar to the RF lens assembly 1000 of FIG. 16, but instead of a single heat dissipation element 1020, the RF lens 1005 includes a plurality of heat dissipation elements 1020*a*, 1020*b*, and 1020*c*. Operation of each of the heat dissipation elements 1020*a*, 1020*b*, and 1020*c* is similar to that of the heat dissipation element 1020 of FIG. 16 described above. The heat dissipation elements 1020, 1020*a*, 1020*b*, and 1020*c* may be placed in the RF energy focusing material 1010 in those areas that heat up the most. Typically, these are areas that intersect with the radiation profiles of the RF beams generated by the radiating elements of the antenna. Frequently, the radiation patterns of several beams may intersect in the center of the RF lens assembly 1005 as shown, for example, in FIG. 1C. Thus, a single heat dissipation element 1020 may be used as shown in FIG. 16 to extract heat from this region of the RF energy focusing material 1010 where multiple beams intersect. In other embodiments, multiple heat dissipation elements 1020 may be used, such as shown in FIG. 17, and placed at various locations throughout the RF energy focusing material 1010 so as to intersect with one or more radiation patterns associated with RF beams generated by radiating elements of the base station antenna.

Figure 18:
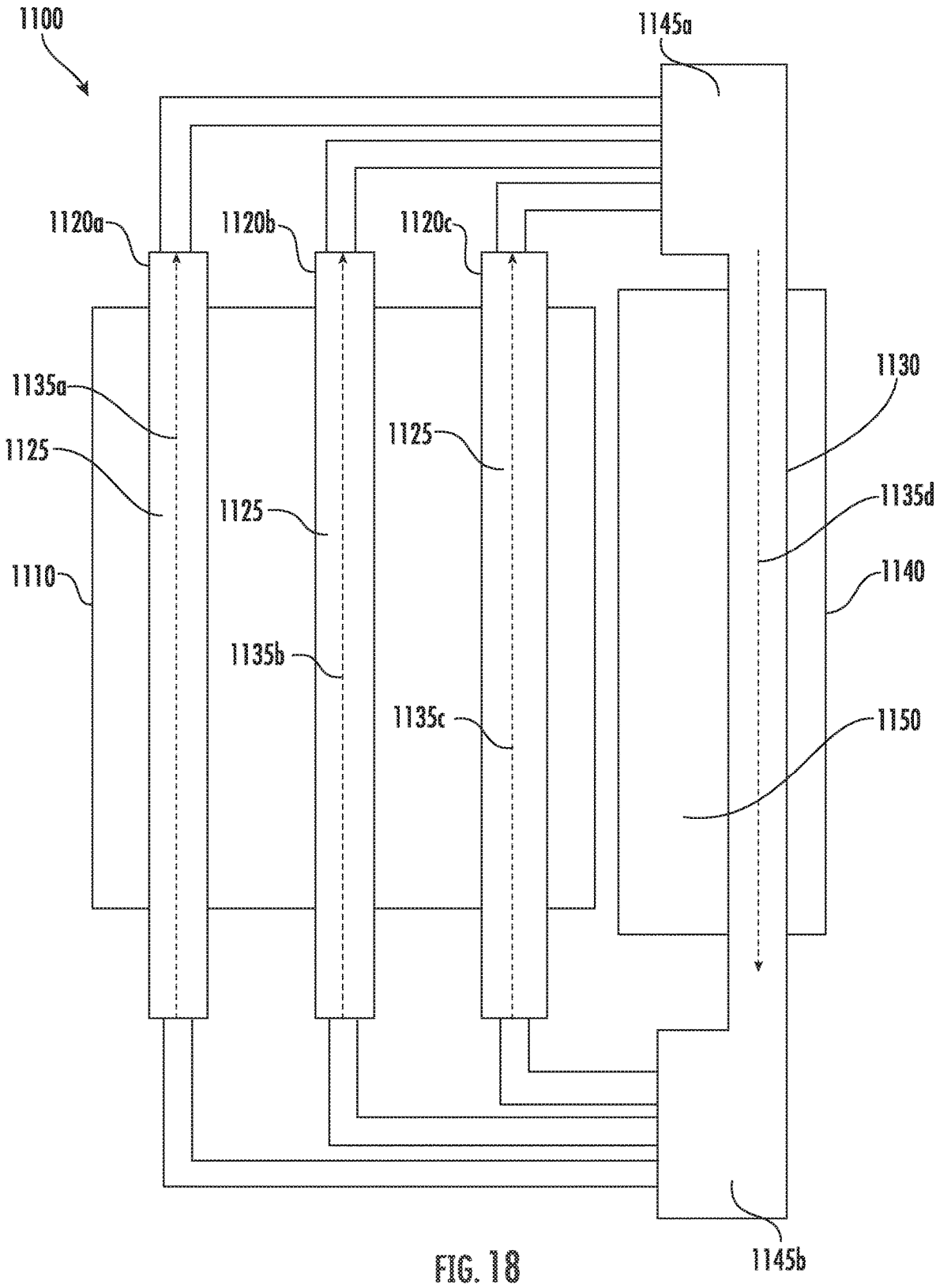
FIG. 18 is a cross-sectional view of an RF lens including multiple heat dissipation elements containing cooling fluid that illustrates circulation of the cooling fluid between the heat dissipation elements and a condenser in accordance with some embodiments of the inventive concept.

FIG. 18 is a cross-sectional view of an RF lens assembly 1100 that can be used in a base station antenna according to some embodiments of the inventive concept. The RF lens assembly 1100 comprises RF energy focusing material 1110, which has heat dissipation elements 1120*a*, 1120*b*, and 1120*c* extending therethrough. Each of the heat dissipation elements 1120*a*, 1120*b*, and 1120*c* may be a heat dissipation channel that contains a cooling fluid 1125. A condenser 1130 is coupled to the heat dissipation elements 1120*a*, 1120*b*, and 1120*c* to facilitate the extraction of heat from the RF energy focusing material 1110. A reflector 1150, which is used to direct RF beams generated by the radiating elements in a base station antenna may be adjacent the condenser 1130. As shown in FIG. 18, as the cooling fluid 1125 heats up, for example, due to the transmission of RF beams through the RF energy focusing material 1110, the cooing fluid 1125 may rise (move vertically as represented by the fluid flow paths 1135*a*, 1135*b*, and 1135*c*) and transition to a gas state thereby absorbing thermal energy. The coolant fluid 1125 in the gas state may be received into the condenser 1130 through a coolant return manifold 1145*a*. The condenser 1130 may include cooling fins 1140 and may be configured to cool the cooling fluid 1125 so that it condenses back into a liquid state from a gas state as is travels down the condenser 1140 along the fluid flow path 1135*d*. The cooling fins 1140 may be used to increase the surface area of the condenser 1130 to enhance the heat transfer capability of the condenser 1130. The cooling fluid 1125, which is now in a liquid state, may exit the manifold 1130 via a coolant supply manifold 1145*b* and return to the heat dissipation elements 1120*a*, 1120*b*, and 1120*c* where the process of absorbing and dissipating thermal energy from the RF energy focusing material 1110 repeats.

While the RF lens assembly 1100 of FIG. 18 is shown as including multiple heat dissipation elements 1120*a*, 1120*b*, and 1120*c*, it will be understood that a single heat dissipation element may be used in other embodiments and may operate in similar fashion. In addition, the cooling fluid 1125 in FIG. 18 is illustrated as transitioning to a gas state due to the temperature inside the RF energy focusing material 1110. In other embodiments, the cooling fluid 1125 does not transition between the liquid and gas states, but instead remains in a liquid state during the cooling process. Heated cooling fluid 1125 flows into the condenser 1030 where the fluid is cooled and then returned into the heat dissipation element 1120*a*, 1120*b*, and 1120*c*.

Figure 19A:
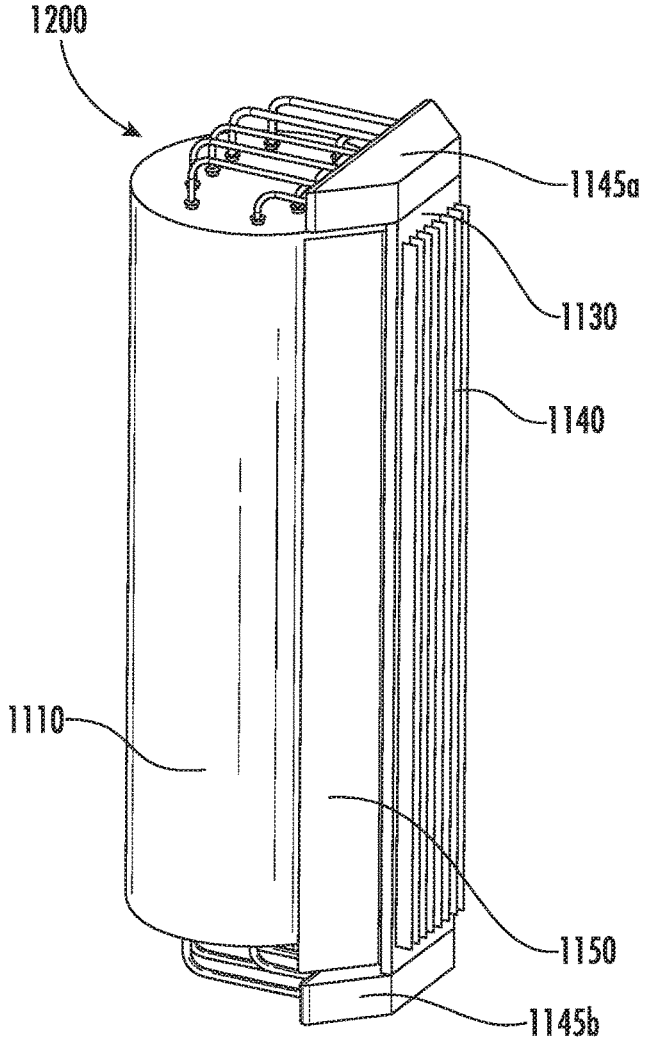
FIGS. 19A and 19B are perspective views of an RF lens including multiple heat dissipation elements containing cooling fluid that illustrates circulation of the cooling fluid between the heat dissipation elements and a condenser in accordance with some embodiments of the inventive concept.
Figure 19B:
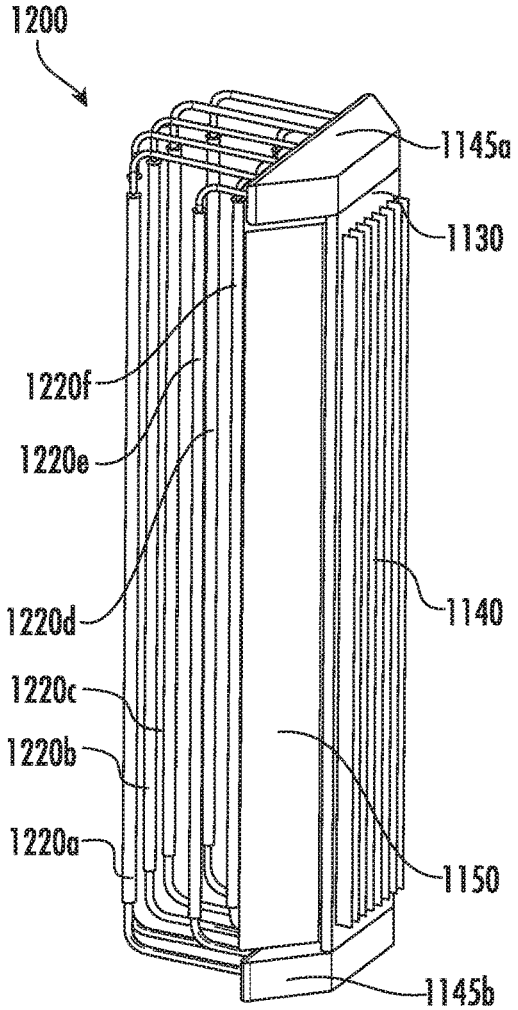

FIGS. 19A and 19B are perspective views of an RF lens assembly 1200 in which the RF energy focusing material is included and the RF energy focusing material is removed, respectively, according to some embodiments of the inventive concept. The RF lens assembly 1200 is the same as the RF lens assembly 1100 of FIG. 18 with the exception being that eight heat dissipation elements 1220*a*, 1220*b*, 1220*c*, 1220*d*, 1220*e*, 1220*f*, 1220*g* (hidden from view), and 1220*h* (hidden from view)' are shown instead of only three heat dissipation elements 1120*a*, 1120*b*, and 1120*c*.

Figure 20:
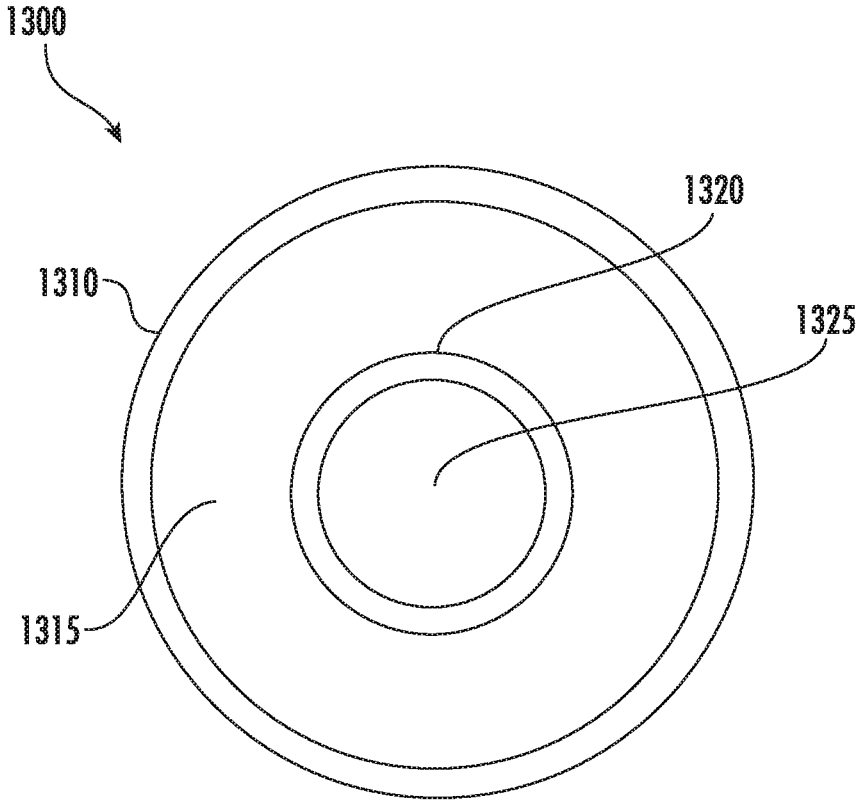
FIG. 20 is a cross-sectional view of a heat dissipation element including an outer pipe and an inner pipe in accordance with some embodiments of the inventive concept.

The heat dissipation elements of FIGS. 16-18, 19A, and 19B have been illustrated as heat dissipation channels as formed as a pipe with the cooling fluid contained therein. The heat dissipation elements of FIGS. 2E and 2F have been illustrated as heat dissipation channels formed as an air-filled pipe. FIG. 20 is a cross-sectional view of a heat dissipation element 1300 that may be used in an RF energy focusing material of an RF lens to facilitate the cooling thereof and combines aspects of the heat dissipation element embodiments of FIGS. 16-18, 19A, and 19B and the heat dissipation element embodiments of FIGS. 2E and 2F according to some embodiments of the inventive concept. As shown in FIG. 20, the heat dissipation element 1300 comprises an outer pipe 1310 with an inner pipe 1320 inside the outer pipe 1310 thereby forming a first chamber 1315 and a second chamber 1325. The first chamber 1315 may contain cooling fluid, such as that described above with respect to FIGS. 16-18, 19A, and 19B and the second chamber 1325 may contain air and/or a lattice structure that is configured to rectify electromagnetic radiation generated by the radiating elements of a base station antenna. In other embodiments, the second chamber 1325 may contain the cooling fluid and the first chamber 1315 may contain air and/or a lattice structure. In some embodiments of the inventive concept, a thickness of the walls forming each of the outer and inner pipes 1310 and 1320 may be about 3 mm. The outer diameter of the outer pipe 1310 may be about 3.5" and the outer diameter of the inner pipe 1320 may be about 2.5".

In accordance with some embodiments of the inventive concept, the material used to form the heat dissipation elements of FIGS. 16-18, 19A, and 19B may be a thermally conductive plastic, such as polyvinyl chloride (PVC). The dielectric constant of the material used to form the heat dissipation elements may be adjusted to achieve a desired RF performance.

For example, antenna systems are generally designed to tailor the thickness of dielectric materials to be some multiple of a wavelength of the radio signal in the dielectric material. The wavelength of a radio signal in free space is equal to the speed of light divided by the frequency as set forth in Equation 1:

$$\lambda_0 = c_0/f_c, \qquad \text{EQ. 1}$$

$c_0$ is the speed of light and $f_c$ is the radio signal frequency in free space.

The wavelength of the radio signal in the dielectric material $\lambda_m$ is related to the wavelength of the radio signal in free space $\lambda_0$ by Equation 2:

$$\lambda_m = \lambda_0/\mathrm{SQRT}\varepsilon_r$$

where SQRT is the square root and $\varepsilon_r$ is the relative permittivity of the dielectric material, e.g., the dielectric constant of the dielectric material.

Thus, given a radio signal frequency and a thickness $T_m$ for the dielectric material, the dielectric constant of the material may be adjusted to reduce insertion loss and improve RF performance of the base station antenna system.

In some example embodiments of the inventive concept, the dielectric constant of the cooling fluid material containing within the heat dissipation elements may be greater than or equal to about 1.8.

As described above with respect to FIGS. 16-18, 19A, and 19B, the cooling fluid may be configured to transition from a liquid state to a gas state in response to heat from the RF energy focusing material. In some embodiments, the cooling fluid may be configured to transition from a liquid state to a gas state upon reaching a temperature threshold in a range from about 45° C. to about 60° C. An example cooling fluid that transitions from a liquid state to a gas state in this temperature range is 3M™ Fluorinert™ FC-72. In other embodiments described above with respect to FIGS. 16-18, 19A, and 19B, the cooling fluid may be configured to remain in a liquid state during expected operational temperatures of the RF energy focusing material. An example cooling fluid that remains in the liquid state during expected operational temperatures of the RF energy focusing material is 1,1,1,2-Tetrafluoroethane commonly known as R134A.

In some embodiments of the inventive concept, the heat dissipation elements as described herein with respect to the embodiments of FIGS. 2E, 2F, 16-18, 19A, and 19B may be oriented so as to extend in a general vertical orientation through the RF energy focusing material in an RF lens when a base station antenna is mounted for use in an installation. The heat dissipation elements in accordance with the embodiments described herein may be used in a variety of different RF lens types including, but not limited to, cylindrical RF lenses, spherical RF lenses, and ellipsoidal RF lenses.

In the embodiments described above with respect to FIGS. 16-18, 19A, and 19B, a condenser used to facilitate cooling of the cooling fluid used in the heat dissipation elements may be positioned in a variety of configurations with respect to the RF lens assembly including, but not limited to, at either or both ends of the heat dissipation elements as shown in FIGS. 16 and 17 and on a side of the lens assembly so as to extend along a length of the RF lens as shown in FIGS. 18, 19A, and 19B.

Figure 21:
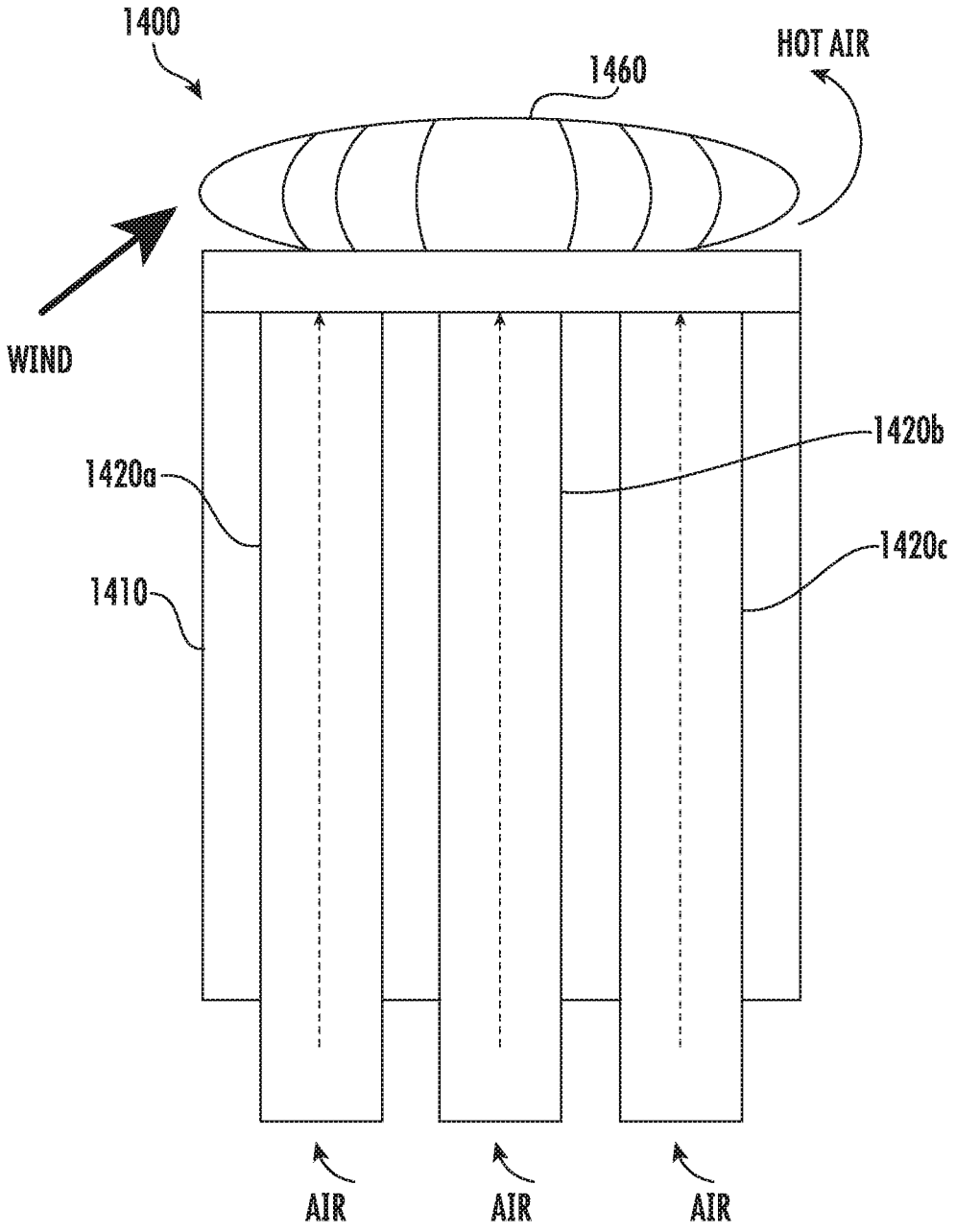
FIG. 21 is a cross-sectional view of an RF lens including a turbine for extracting heat through heat dissipation elements in accordance with some embodiments of the inventive concept.

FIG. 21 is a cross-sectional view of an RF lens assembly 1400 that can be used in a base station according to some embodiments of the inventive concept. The RF lens assembly 1400 comprises RF energy focusing material 1410, which has heat dissipation elements 1420*a*, 1420*b*, and 1420*c* extending therethrough. The heat dissipation elements 1420*a*, 1420*b*, and 1420*c* may be air filled heat dissipation elements, such as those described above with respect to FIGS. 2E and 2F, heat dissipation elements that include an inner pipe and outer pipe with one chamber being air filled and the other chamber being cooling fluid filled, such as those described above with respect to FIG. 20, or a combination of one or more heat dissipation elements being air filled and one or more heat dissipation elements being a combination of cooling fluid filled and air filled. As shown in FIG. 21, the RF lens assembly further comprises a turbine 1460, which, in some embodiments, may be a wind activated turbine. The turbine 1460 is coupled to first ends of the heat dissipation elements 1420*a*, 1420*b*, and 1420*c* a first end of the RF lens assembly 1400 with opposing ends of the heat dissipation elements 1420*a*, 1420*b*, and 1420*c* being open to the atmosphere. When the turbine 1460 rotates in response to wind, for example, it may pull air into the heat dissipation elements 1420*a*, 1420*b*, and 1420*c* through the air filled pipes (FIGS. 2E and 2F embodiments) or chambers, e.g., inner pipe 1320 of FIG. 20. The heated air from the heat dissipation elements 1420*a*, 1420*b*, and 1420*c* is then vented to the atmosphere through the turbine 1460. To reduce the risk of passive intermodulation interference (PIM), the turbine 1460 may be made of a non-metallic material. While the RF lens assembly 1400 of FIG. 21 is shown as including multiple heat dissipation elements 1420*a*, 1420*b*, and 1420*c*, it will be understood that a single heat dissipation element may be used in other embodiments and may operate in a similar fashion.

Figure 22:
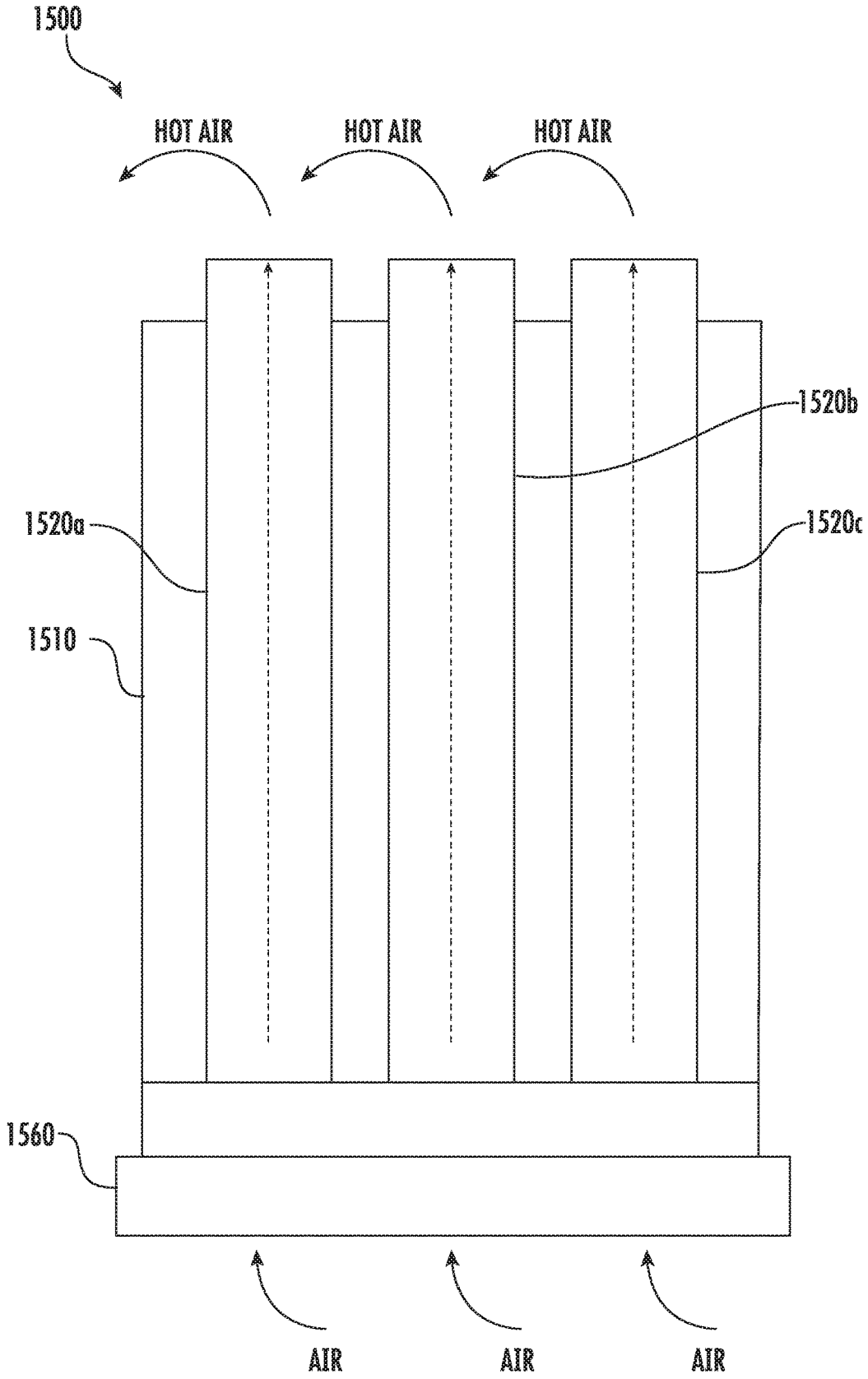
FIG. 22 is a cross-sectional view of an RF lens including a vent for extracting heat through heat dissipation elements in accordance with some embodiments of the inventive concept.

FIG. 22 is a cross-sectional view of an RF lens assembly 1500 that can be used in a base station according to some embodiments of the inventive concept. The RF lens assembly 1500 comprises RF energy focusing material 1510, which has heat dissipation elements 1520*a*, 1520*b*, and 1520*c* extending therethrough. The heat dissipation elements 1520*a*, 1520*b*, and 1520*c* may be air filled heat dissipation elements, such as those described above with respect to FIGS. 2E and 2F, heat dissipation elements that include an inner pipe and outer pipe with one chamber being air filled and the other chamber being cooling fluid filled, such as those described above with respect to FIG. 20, or a combination of one or more heat dissipation elements being air filled and one or more heat dissipation elements being a combination of cooling fluid filled and air filled. As shown in FIG. 22, the RF lens assembly further comprises a vent 1560, which may be rotatably coupled to first ends of the heat dissipation elements 1520*a*, 1520*b*, and 1520*c* at a first end of the RF lens assembly 1500 with opposing ends of the heat dissipation elements 1520*a*, 1520*b*, and 1520*c* being open to the atmosphere. The vent 1560 may be configured, for example, to face the wind so as to push or direct air into the heat dissipation elements 1520*a*, 1520*b*, and 1520*c* through the air filled pipes (FIGS. 2E and 2F embodiments) or chambers, e.g., inner pipe 1320 of FIG. 20. The heated air from the heat dissipation elements 1520*a*, 1520*b*, and 1520*c* is then vented to the atmosphere at the opposing ends of the heat dissipation elements 1520*a*, 1520*b*, and 1520*c*. To reduce the risk of passive intermodulation interference (PIM), the vent 1560 may be made of a non-metallic material. While the RF lens assembly 1500 of FIG. 22 is shown as including multiple heat dissipation elements 1520*a*, 1520*b*, and 1520*c*, it will be understood that a single heat dissipation element may be used in other embodiments and may operate in a similar fashion.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Like reference numbers signify like elements throughout the description of the figures.

It will be understood that, although the terms "first," "second," etc. may be used herein to describe various elements, these elements should not be limited by these teens. These terms are only used to distinguish one element from another. Thus, a first element could be termed a second element without departing from the teachings of the inventive concept.

Terms such as "top," "bottom," "upper," "lower," "above," "below," and the like are used herein to describe the relative positions of elements or features. For example, when an upper part of a drawing is referred to as a "top" and a lower part of a drawing is referred to as a "bottom" for the sake of convenience, in practice, the "top" may also be called a "bottom" and the "bottom" may also be a "top" without departing from the teachings of the inventive concept.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

What is claimed is:

1. A lensed base station antenna, comprising:

a first array that includes a plurality of first radiating elements that are configured to transmit respective sub-components of a first radio frequency ("RF") signal;

a second array that includes a plurality of second radiating elements that are configured to transmit respective sub-components of a second RF signal;

an RF lens positioned to receive electromagnetic radiation from a first of the first radiating elements and from a first of the second radiating elements, the RF lens including an RF energy focusing material; and a first heat dissipation channel that extends through the RF energy focusing material of the RF lens.

2. The lensed base station antenna according to claim 1, wherein the first heat dissipation channel is one of a plurality of heat dissipation channels that extend through the RF energy focusing material of the RF lens.

3. The lensed base station antenna according to claim 2, wherein at least some of the heat dissipation channels comprise air-filled pipes that extend vertically through the RF lens when the base station antenna is mounted for use.

4. The lensed base station antenna according to claim 3, wherein the RF lens comprises an outer shell, the RF energy focusing material within the outer shell, and the plurality of heat dissipation channels extending vertically through the RF energy focusing material.

5. The lensed base station antenna according to claim 2, wherein the first of the heat dissipation channels extends vertically through a center of the RF lens when the base station antenna is mounted for use.

6. The lensed base station antenna according to claim 1, further comprising a fan that is positioned to draw air through the first heat dissipation channel.

7. The lensed base station antenna according to claim 3, wherein the pipes are formed of a thermally conductive plastic material.

8. The lensed base station antenna according to claim 1, wherein the RF energy focusing material comprises an artificial dielectric material.

9. The lensed base station antenna according to claim 8, further comprising a housing, wherein the RF lens is within the housing and the first heat dissipation channel extends through the housing.

10. The lensed base station antenna according to claim 9, wherein the housing includes a radome and a bottom end cap, wherein the first heat dissipation channel extends outside of the RF lens and through the bottom end cap.

11. The base station antenna according to claim 10, wherein the first heat dissipation channel also extends through a top end cap of the housing.

12. The base station antenna according to claim 10, wherein the first heat dissipation channel extends vertically through a center of the RF lens.

13. The base station antenna according to claim 10, wherein the RF lens comprises a cylindrical RF lens.

14. The lensed base station antenna according to claim 1, wherein the first heat dissipation channel that extends through the RF energy focusing material of the RF lens contains a cooling fluid.

15. The base station according to claim 14, wherein the first heat dissipation channel is one of a plurality of heat dissipation channels that extend through the RF energy focusing material of the RF lens and each of the plurality of heat dissipation channels contains the cooling fluid.

16. The base station antenna according to claim 15, further comprising:

a condenser that is coupled to the plurality of heat dissipation channels so as to facilitate circulation of the cooling fluid therebetween.

17. The base station antenna according to claim 15, wherein each of the plurality of heat dissipation channels comprises an outer pipe and an inner pipe within the outer pipe, and wherein the cooling fluid is between the inner pipe and the outer pipe.

18. The base station antenna according to claim 14, wherein the RF lens comprises an outer shell, the RF energy focusing material within the outer shell, and the first heat dissipation channel extends vertically through the RF energy focusing material.

19. The base station antenna according to claim 16, wherein the cooling fluid is configured to transition from a liquid state into a gas state in response to heat from the RF energy focusing material.

20. The base station antenna according to claim 19, wherein the condenser is configured to cool the cooling fluid so as to cause a transition of the cooling fluid from the gas state to the liquid state.

* * * * *